US009879908B2

(12) United States Patent
Triglia, Jr.

(10) Patent No.: US 9,879,908 B2
(45) Date of Patent: Jan. 30, 2018

(54) SYSTEM AND METHOD OF REMOVING MOISTURE FROM FIBROUS OR POROUS MATERIALS USING MICROWAVE RADIATION AND RF ENERGY

(71) Applicant: Joseph P. Triglia, Jr., West Islip, NY (US)

(72) Inventor: Joseph P. Triglia, Jr., West Islip, NY (US)

(73) Assignee: TRIGLIA TECHNOLOGIES, INC., West Islip, NY (US)

( * ) Notice: Subject to any disclaimer, the term of this patent is extended or adjusted under 35 U.S.C. 154(b) by 0 days.

(21) Appl. No.: 15/029,121

(22) PCT Filed: Oct. 17, 2014

(86) PCT No.: PCT/US2014/061025

§ 371 (c)(1),
(2) Date: Apr. 13, 2016

(87) PCT Pub. No.: WO2015/058027

PCT Pub. Date: Apr. 23, 2015

(65) Prior Publication Data

US 2016/0258680 A1 Sep. 8, 2016

Related U.S. Application Data

(60) Provisional application No. 61/892,234, filed on Oct. 17, 2013.

(51) Int. Cl.
*F26B 3/00* (2006.01)
*F26B 3/347* (2006.01)
(Continued)

(52) U.S. Cl.
CPC ..... *F26B 3/347* (2013.01); *F26B 13/008* (2013.01); *F26B 15/18* (2013.01); *F26B 2210/14* (2013.01); *F26B 2210/16* (2013.01)

(58) Field of Classification Search
CPC ..... F26B 3/347; F26B 13/008; F26B 15/18; F26B 2210/14; F26B 2210/16
(Continued)

(56) References Cited

U.S. PATENT DOCUMENTS 3,474,544 A 10/1969 Holden et al.
3,619,536 A * 11/1971 Boehm ..... H05B 6/6402 219/717
(Continued)

FOREIGN PATENT DOCUMENTS

AT 507414 A4 * 5/2010 ..... B27K 3/32
CA 2821722 A1 * 6/2012 ..... H05B 6/707
(Continued)

OTHER PUBLICATIONS

Machine translation for Gruber AT 507414 on Jun. 30, 3017.*
(Continued)

*Primary Examiner* — Stephen M Gravini
(74) *Attorney, Agent, or Firm* — Hoffmann & Baron, LLP

(57) ABSTRACT

A system and method for removing moisture from a fibrous material includes applying microwave radiation combined with RF to the fibrous material to heat and evacuate moisture from the fibrous material during a heating cycle and optionally alternating heating cycles with drying/cooling cycles. The fibrous material can be, for example, sawn or dimensional lumber. The application of alternating microwave and RF in a controlled and continuous process advantageously mimics the heating, rewetting and drying cycles of a conventional kiln without the need for batch processing. Accordingly, a faster and more cost-efficient drying process is possible with no defects imparted to the wood in the process.

20 Claims, 13 Drawing Sheets

(51) Int. Cl.
*F26B 13/00* (2006.01)
*F26B 15/18* (2006.01)

(58) Field of Classification Search
USPC ..... 34/256
See application file for complete search history.

(56) References Cited

U.S. PATENT DOCUMENTS

| | | | | | |
|---|---|---|---|---|---|
| 3,721,013 | A * | 3/1973 | Miller | F26B 3/343 | 219/710 |
| 3,744,147 | A | 7/1973 | Pless | | |
| 3,849,063 | A | 11/1974 | Eichenlaub | | |
| 3,872,603 | A | 3/1975 | Williams et al. | | |
| 4,622,446 | A | 11/1986 | Sugisawa et al. | | |
| 4,640,020 | A | 2/1987 | Wear et al. | | |
| 4,746,968 | A | 5/1988 | Wear et al. | | |
| 4,831,747 | A | 5/1989 | Roos et al. | | |
| 5,020,237 | A | 6/1991 | Gross et al. | | |
| 5,026,957 | A * | 6/1991 | Pralus | H05B 6/64 | 219/731 |
| 5,135,122 | A | 8/1992 | Gross et al. | | |
| 5,536,921 | A | 7/1996 | Hedrick et al. | | |
| 5,979,073 | A * | 11/1999 | Fuls | F26B 3/347 | 34/259 |
| 6,105,278 | A | 8/2000 | Gerrish et al. | | |
| 7,007,405 | B2 * | 3/2006 | Hajek | F26B 3/347 | 34/259 |
| 7,089,685 | B2 | 8/2006 | Torgovnikov et al. | | |
| 7,230,217 | B2 | 6/2007 | Risman | | |
| 7,470,876 | B2 | 12/2008 | Drozd et al. | | |
| 9,096,079 | B2 * | 8/2015 | Priebe | B41J 11/002 | |
| 9,470,455 | B2 * | 10/2016 | Stanish | F26B 25/22 | |
| 2004/0231184 | A1 | 11/2004 | Wefers | | |
| 2006/0006172 | A1 * | 1/2006 | Sedlmayr | B01D 1/0017 | 219/688 |
| 2012/0160843 | A1 * | 6/2012 | Felty, Jr. | H05B 6/707 | 219/756 |
| 2016/0258680 | A1 * | 9/2016 | Triglia, Jr. | F26B 3/347 | |

FOREIGN PATENT DOCUMENTS

| | | | | |
|---|---|---|---|---|
| JP | 2923266 | B2 | 1/1999 | |
| RU | 2101630 | C1 * | 1/1998 | |
| WO | WO 2012087874 | A2 * | 6/2012 | H05B 6/707 |

OTHER PUBLICATIONS

International Search Report and Written Opinion issued in International Application No. PCT/US2014/061025 dated Jan. 30, 2015.
James Benford, "Flight and Spin of Microwave-Driven Sails: First Experiments", Microwave Sciences Inc., Lafayette, CA, Pulsed Power Plasma Science, 2001, PPPS-2001, Digest of Technical Papers, (vol. 1).
Zwick et al. "Commercial RFV Kiln Drying—Recent Successes", Western Dry Kiln Association, May 2000, p. 36-44.
G. Brodie, "Microwave Treatment Accelerates Solar Timber Drying", American Society of Agricultural and Biological Engineers, 2007, p. 389-396, vol. 50(2).
Dan Bousquet, "Lumber Drying: An Overview of Current Processes", University of Vermont Extension, Sep. 2000, p. 1-8.
John F. Hunt et al., "Development of New Microwave-Drying and Straightening Technology for Low-Value Curved Timber", National Fire Plan Research Program USDA Forest Service, Research Note FPL-RN-0296.
Nola Wilkinson, "Microwaves and Wood Processing", CRC Wood Innovations Fact Sheet, The University of Melbourne, CRC Wood Innovations, Australia.

* cited by examiner

800

810

900

910

SYSTEM AND METHOD OF REMOVING MOISTURE FROM FIBROUS OR POROUS MATERIALS USING MICROWAVE RADIATION AND RF ENERGY

CROSS-REFERENCE TO RELATED APPLICATIONS

This application claims priority to International Application No. PCT/US2014/061025 filed on Oct. 17, 2014, which claims the benefit of priority of provisional U.S. Patent Application No. 61/892,234 filed on Oct. 17, 2013, both of which are incorporated herein by reference in their entirety.

FIELD OF THE DISCLOSURE

The present disclosure is related to the removal of moisture from fibrous or porous materials using the delivery of microwave radiation combined with radio frequency (RF) energy, particularly, for the removal of moisture from cellulose-based materials, such as sawn and dimensional wood or porous materials, such as ceramic.

BACKGROUND

In the process of manufacturing fibrous materials, particularly, cellulose-based materials, such as wood, paper, textile and other materials, moisture must be removed to a desired moisture content level, while maintaining a uniform moisture profile. Failure to do so can result in inferior and defective product. For example, in the process of drying green wood, typically using a kiln, free water from cell lumina will naturally be depleted first, while the bound water (bound to the wood via hydrogen bonds) saturating the cell walls will remain until all of the free water is removed. The moisture content remaining in the cell walls after the free water has been removed is referred to as the Fiber Saturation Point (FSP), and is typically between around 24 to 32% and could reach levels of approximately 70%. The FSP further defines the moisture content below which, as the wood is further dried, properties such as volume and strength are affected. As is the case in typical kiln drying, the outer surfaces will dry and consequently shrink faster than the interior portions of the wood. As a consequence of this relative shrinkage, the wood can crack and split (a defect generally referred to as "checking"). In addition, if the faster drying portions become too dry at any point during the process, the strength of the material can be altered and warping of the wood can occur.

To mitigate these problems, conventional kiln drying processes include alternately heating and drying the wood with a moisture-removal mechanism, such as circulating unsaturated air to remove the moisture as it evaporates off, and rewetting the wood to redistribute the moisture in order to restore a more uniform moisture profile throughout the bulk of the material. For the heating process, various conduction, convection, and radiation heating methods have been used, including electrical heating means, steam-heated heat exchangers, and solar energy. In this so-called charging phase of a conventional kiln, as the temperature rises in the kiln, the wood surface is typically "overdried" so that the moisture content of faster drying portions is less than that of the desired final product. During the discharge or rewetting phase, the relative humidity in the kiln rises as the temperature falls. This slows the surface drying rate and equalizes the moisture profile through the wood. Air is also constantly circulating through the kiln and around the wood to remove moisture and assist in drying the wood. The rewetting and drying are typically further controlled by regulating the temperature and humidity of the air circulating in the kiln.

There are many disadvantages using such conventional kilns including possible loss of the strength of the wood due to overdrying of the outer surfaces, the possibility of other defects in the wood due to the difficulty in maintaining a uniform moisture profile, high energy consumption, and the release of pollutants into the atmosphere. In addition, the long drying times and relatively small amount of wood that can be processed in each batch cause a bottleneck in the entire production process.

Other known traditional methods of drying hardwood timbers can take several months requiring controlled conditions to prevent damage to the timbers. Such known drying processes are controlled so that the loss of moisture is gradual and the timber or wood shrinks evenly. These processes can take as long as 60 days.

To overcome some of the disadvantages of conventional methods of drying hardwood and other methods of kiln drying, early attempts were made to use microwave radiation to try to remove moisture from wood. However, such early attempts failed due to collection of moisture in the microwave emitter, causing it to malfunction, and on the surface of the material, preventing further removal of moisture from within the bulk of the material.

A method of using microwave to pretreat wood prior to applying conventional kiln drying techniques is disclosed in U.S. Pat. No. 7,089,685 to Torgovnikov, et al. (referred to hereinafter as the "'685" patent). The '685 patent discloses subjecting a surface of wood to microwave at 0.1 to 24 GHz to provide a modified wood zone on the exterior having increased permeability relative to the untreated core volume of the wood. The '685 patent discloses that this microwave pretreatment reduces the time required for the subsequent drying process using a conventional kiln. A variation of the kiln drying process uses RF in vacuum ("RF/V") to heat a stack of wood volumetrically, causing a more uniform moisture profile in the heating process, and causing the kiln environment to become superheated. The wood is heated under vacuum to create a pressure gradient, the pressure decreasing toward the surface, to draw the moisture toward the outer surfaces. The moisture quickly converts to water vapor at the reduced pressure and can be condensed or drawn out of the kiln by a vacuum pump as steam during the discharge and moisture removal phase. The humidity and temperature are controlled to allow a certain amount of moisture to remain on the surface of the wood to avoid overdrying and to insure a uniform moisture profile to relieve internal and external stress in the wood throughout the process. While such RF/V systems speed up the wood drying process, they have a high operating cost due to the energy requirements of generating the RF and vacuum pumps. In addition, like the other kiln systems, RF/V is a batch process which is limited in the capacity of wood that can be processed at one time. Accordingly, a need still exists for a system and method of removing moisture from fibrous materials such as sawn and dimensional wood. It is especially desirable for the system and method to operate at a reduced energy and manufacturing cost and in a continuous mode rather than in a batch process It is even further desirable for a more effective system and method that reduces prolonged drying times associated with conventional kiln and RF Vacuum batch kiln processes. It is even further desirable for the system and method to offer additional commercial and environmental benefits including the prospect of new products that extend our existing timber resources and reduce any unnecessary damage to timber resources that require any such wood drying treatment. It is even further desirable for the system and method to permit and accelerate processing of sawn, dimensional wood or timber such as preservative treatments for generating environmentally friendly end-products.

SUMMARY

The present disclosure provides a system and method of removing moisture from fibrous materials, particularly, from sawn and dimensional wood using microwave radiation. In addition, the present disclosure is applicable to removing moisture from materials, such as porous or other materials structurally known to bound or absorb moisture, such as ceramic slabs.

In contrast to the batch systems of the prior art, the system and method of the present disclosure advantageously provide a continuous process for removal of moisture from fibrous materials such as sawn and dimensional lumber. The process preferably includes translating the fibrous material, for example, lumber, on a conveyor belt through an enclosure in which the heating and drying of the lumber is conducted. The method includes alternatingly applying a heating phase to a portion of the lumber followed by a drying (cooling) phase for the removal of moisture until the lumber reaches a desired final moisture content. The heating phase is provided by irradiating the portion of the lumber with microwave for a period of time and with sufficient intensity to heat and vaporize moisture preferably throughout the entire thickness of the lumber without significant destruction to the ray cell tissue of the wood. Preferably, air is constantly circulated through the enclosure using ventilation and exhaust fans during the heating process. In addition, drying or cooling phases can also be provided in the absence of microwave or other heating for a period of time determined by at least one of a number of constantly monitored parameters, such as change in the overall moisture content of the wood, or in the uniformity of a moisture profile within the wood. In this way, the heating and drying schedules of conventional kilns are essentially performed in a continuous, rather than a batch, process, and at a significantly faster rate.

In one aspect, the portion of the lumber that is irradiated by microwave corresponds to a length of the lumber that is contained within the enclosure. Accordingly, microwave is applied along the entire length and width of lumber within the enclosure for a first period of time to provide the heating phase, and is accompanied by or associated with any appropriate method for a second period of time to provide the drying and cooling phase. Preferably, ventilation and exhaust fans are continuously used to circulate air through the enclosure to remove moisture from the surface of the lumber and from the enclosure, particularly during the drying phase.

In another aspect, the alternating periods of microwave heating and drying, preferably using circulating air, are provided by translating the material, for example, lumber, on a conveyor belt through an enclosure that provides a number of rectangular swaths of electro-magnetic radiation, including RF and/or microwave, for heating a portion of the lumber. Each rectangular swath extends across a width of the conveyor belt, transverse to the direction of translation of the conveyor belt. The rectangular swaths are separated by a fixed distance. Accordingly, the enclosure contains alternating rectangular swaths of microwave radiation for providing heating phases, separated by rectangular drying regions that are not irradiated by microwave for alternating the heating phases with drying phases. The periods of time corresponding to the heating and drying phases are controlled by the speed of the conveyor belt, the length of the rectangular swaths in the direction of the conveyor belt, and the separations between the rectangular swaths.

In various aspects, the method can also include alternating the application of microwave radiation with the application of longer wavelength RF within a microwave heating phase, or following a microwave heating phase. For example, the rectangular swaths of microwave irradiated sections of the enclosure can be staggered between pairs of opposing electrodes along the conveyor belt for the application of RF to the portion of lumber as it translates along the conveyor belt. One or both of the applications of RF and microwave heating can be periodically accompanied or combined for a period of time with a drying phase. Air is circulated over the portion of the lumber at least during the drying cycle to remove the moisture evacuated therefrom.

Optionally, the microwave heating can be accompanied by RF during a heating phase for predetermined periods of time. Alternatively, the microwave heating can be interrupted by RF pulses during a heating phase for predetermined periods of time.

In one aspect, a method for removing moisture from a fibrous material includes irradiating a portion of the fibrous material with microwave to heat and vaporize moisture within the fibrous material during a heating cycle; and accompanying or combined with the delivery of microwave with RF heating for a period of time during the heating cycle to equalize and draw the moisture within the fibrous material to outer surfaces of the fibrous material.

The method preferably further includes circulating air over the portion of the fibrous material to remove the moisture evacuated therefrom.

In another aspect, a system for removing moisture from a fibrous material includes an enclosure for heating and drying a fibrous material enclosed therein; a microwave delivery device comprising a device positioned interior to the enclosure and directed toward the fibrous or porous material, the device delivering microwave radiation to heat and vaporize moisture within the fibrous material over a period of time corresponding to a heating cycle; a radio-frequency emitter positioned adjacent the microwave delivery device and configured to volumetrically heat at least a portion of the fibrous or porous material; and a power supply operatively connected to the radio-frequency emitter and configured to energize the radio-frequency emitter for a first period of time within the heating cycle, the delivery of microwave radiation also being delivered during the first period of time, the radio-frequency emitter equalizing and drawing the moisture to outer surfaces of the fibrous material for removal.

The system preferably further includes a circulating air device, the circulating air device circulating unsaturated air around the fibrous material and out of the enclosure to remove the moisture evacuated from the fibrous material during the heating cycle.

In particular aspects of the system and method of the disclosure, the fibrous material is sawn lumber, or dimensional lumber.

The disclosed technology is yet further directed to a method for removing moisture from a fibrous or porous material including delivering microwave energy emitted from a waveguide into a first chamber, the microwave energy being dispersed into the first chamber, delivering microwave energy from the first chamber to a second chamber, the second chamber being situated proximate to a zone of energy delivery, delivering microwave energy from the second chamber to the zone of energy delivery, the fibrous or porous material being located within or near the zone of energy delivery; and irradiating a portion of the fibrous or porous material within or near the zone of energy delivery with microwave, the microwave removing moisture within the fibrous or porous material. The method further including delivering RF energy emitted from a pair of RF plates to the fibrous or porous material located within or near the zone of energy delivery. The method further including the RF energy removing moisture from the fibrous or porous material located within or near the zone of energy delivery. The method of further including detecting the moisture level of the fibrous or porous material located within or near the zone of energy delivery. The method yet further including transmitting a signal to a microwave generator or RF generator, the signal associated with adjusting the power level of microwave or RF. The method yet further including transmitting a signal to a tuning fork, the signal adjusting the impedance level of the microwave. The method further including transmitting a signal to at least one louver, the signal adjusting a degree of rotation of the louver in order to increase or decrease a level of microwave to the material located within or near the zone of energy delivery.

The disclosed technology is yet further directed to a system for removing moisture from a fibrous or porous material including a microwave delivery device for delivering microwave energy emitted from a waveguide into a first chamber, the microwave energy being dispersed into the first chamber, a microwave delivery device for delivering microwave energy from the first chamber to a second chamber, the second chamber being situated proximate to a zone of energy delivery, louvers having variable openings permitting the transmittal of microwave energy from the second chamber to the zone of energy delivery, fibrous or porous material being located within or near the zone of energy delivery, irradiating a portion of the fibrous or porous material within or near the zone of energy delivery with microwave, the microwave removing moisture within the fibrous or porous material. The system further including RF plates configured to deliver RF energy to the fibrous or porous material located within or near the zone of energy delivery. The system further including the RF energy removing moisture from the fibrous or porous material located within or near the zone of energy delivery. The system further including a moisture control device to detect the moisture level of the fibrous or porous material located within or near the zone of energy delivery. The system further including a transmitter to transmit a signal to a microwave generator or RF generator, the signal associated with adjusting a power level of microwave or RF. The system yet further including a second transmitter to transmit a signal to a tuning fork, the signal adjusting the impedance level of the microwave. The system yet further including a third transmitter to transmit a signal to at least one louver, the signal adjusting a degree of rotation of the louver in order to increase or decrease a level of microwave to the material located within or near the zone of energy delivery.

Other features of the present disclosure will become apparent from the following detailed description considered in conjunction with the accompanying drawings. It is to be understood, however, that the drawings are designed as an illustration only and not as a definition of the limits of the claims or the disclosure.

It is to be appreciated that elements in the figures are illustrated for simplicity and clarity. Common but well-understood elements, which may be useful or necessary in a commercially feasible embodiment, are not necessarily shown in order to facilitate a less hindered view of the illustrated embodiments.

DETAILED DESCRIPTION

The following sections describe exemplary embodiments of the present disclosure. It should be apparent to those skilled in the art that the described embodiments of the present disclosure provided herein are illustrative only and not limiting, having been presented by way of example only. All features disclosed in this description may be replaced by alternative features serving the same or similar purpose, unless expressly stated otherwise. Therefore, numerous other embodiments of the modifications thereof are contemplated as falling within the scope of the present disclosure as defined herein and equivalents thereto.

Throughout the description, where items are described as having, including, or comprising one or more specific components, or where processes and methods are described as having, including, or comprising one or more specific steps, it is contemplated that, additionally, there are items of the present disclosure that consist essentially of, or consist of, the one or more recited components, and that there are processes and methods according to the present disclosure that consist essentially of, or consist of, the one or more recited processing steps.

It should be understood that the order of steps or order for performing certain actions is immaterial, as long as the embodiment remains operable. Moreover, two or more steps or actions may be conducted simultaneously.

Scale-up and/or scale-down of systems, processes, units, and/or methods disclosed herein may be performed by those of skill in the relevant art. Processes described herein are configured for batch operation, continuous operation, or semi-continuous operation.

Figure 1:
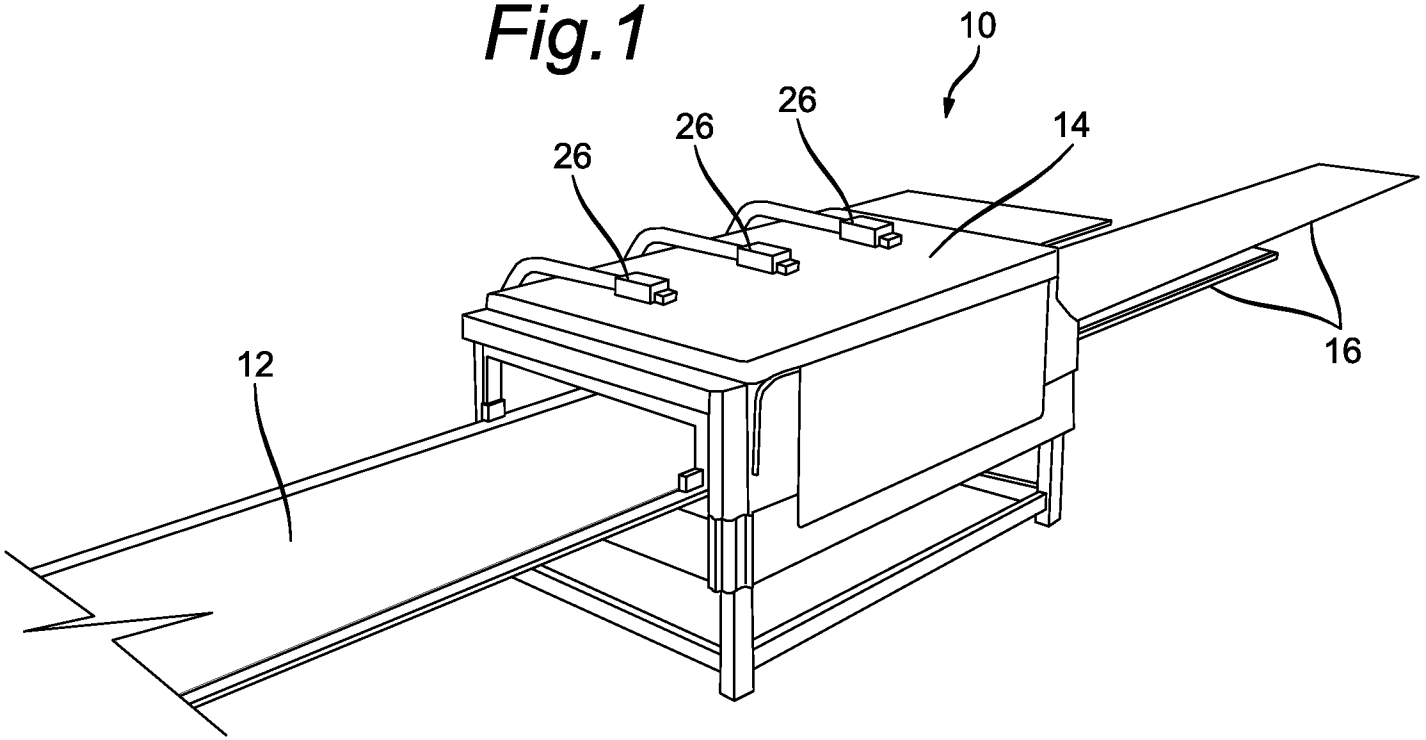
FIG. 1 is a pictorial representation of an embodiment of a system of the present disclosure.
Figure 2:
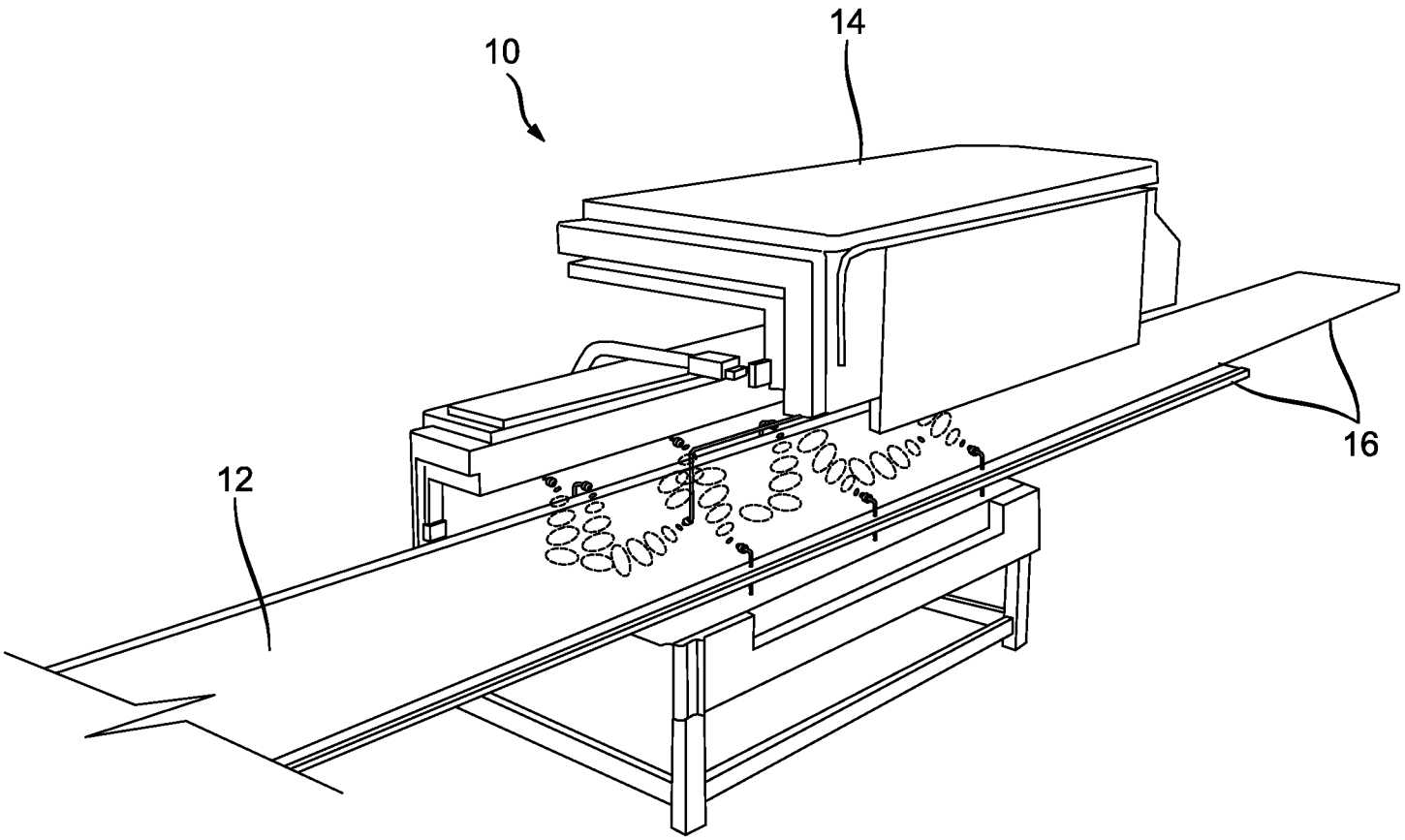
FIG. 2 is a pictorial representation of the embodiment of the system of FIG. 1 with a cutaway of a top of an enclosure of an apparatus of the present disclosure for removing moisture from dimensional lumber.

Referring to FIG. 1, an embodiment of a system 10 of the present disclosure includes a conveyor belt 12 and an enclosure 14, which forms a tunnel through which the conveyor belt 12 translates. Moisture is removed from fibrous materials that are loaded onto the conveyor belt 12 as they translate through the enclosure 14. Waveguide channels may be affixed to the enclosure 14 for delivery of microwave energy at manifolds (26). Referring also to FIG. 2, the enclosure 14 also includes interior surfaces and structures for mounting the various components necessary for heating, drying, and monitoring the materials as they pass through the enclosure 14.

In contrast to the batch systems of the prior art, the system and method of the present disclosure advantageously provide a continuous process for removal of moisture. In an exemplary embodiment shown and described herein, moisture is removed from sawn or dimensional lumber using a representative number of alternating elements or stages that allow alternately heating and drying sections of the lumber as it translates through the enclosure 14. It is understood, however, that the system and method can be adopted for any type of suitable material requiring the removal of moisture. It is also understood that the number, spacing, and configuration of the various elements for heating and drying can be adjusted as necessary to heat and dry the material in a continuous process.

An additional advantage of the system and method of the present technology permits the removal of moisture from sawn and dimensional wood or other porous materials so the resultant treated materials, wood or timber has increased permeability. This increased permeability in effects permits the infusion of environmentally friendly resins that can be infused through such microwave treated wood to improve the process for preservative treatments thereto thereby reducing costs and improving the wood's or porous material's appearance, strength, stability and durability.

Yet, another advantage of the present system and method, is the sterilizing effects of the delivery of microwave irradiation to the materials being dried. Fungi, bacteria and other aetiological agents are destroyed using the disclosed technology system and method.

Preferably, various parameters are continuously monitored throughout the entire wood drying process and used to tune operating parameters in real-time and to achieve a desired level or profile of moisture remaining in the final product. For example, levels and/or changes in an overall moisture content of the lumber as well as in the moisture profile of the lumber are preferably continuously monitored and used to determine system operating parameters. Such system operating parameters include, but are not limited to, the power, intensity, operating frequency, orientation of the electric field strength vector and other operating parameters of the microwave source (and RF, in certain embodiments) of heating, the humidity and temperature of the circulating air used in the drying process, the period of time needed for each heating phase and drying phase, and speed of the conveyor belt.

Generally, the disclosed technology is described as a two-step process which treats the zones of the exterior shell of the wood and treats the core volume of the wood or other porous materials undergoing the drying system and method either simultaneously or in sequence. The electric field vector (E) is generally oriented parallel to the surface of the wood grains for irradiating the exterior shell zones. The electric field vector is also generally oriented perpendicular to the wood grains for irradiation of the core volume. Any additional treatment is implemented and configurable based on the thickness and size of the wood or material being treated. In addition, certain portions of the wood do not require treatment so the system is intelligently adaptive and receptive to the current moisture levels and other conditions of the wood or other material as its being treated and is described in connection with the embodiment shown in FIG. 6 in greater detail below. For example, it may be suitable to treat core regions of the lumber or otherwise desirable to allow an exposed surface to remain untreated. Depending on the application of the wood or other material, it may be suitable to treat the materials accordingly.

Another property of the wood to consider, is that wood cells generally do have a maximum absorption of microwave energy if the E field vector is oriented parallel to the length of the cell. When the E vector is oriented perpendicular to the main wood tissues, the ray cells heat faster than the other tissues of the wood and absorb more energy without destruction to the main wood tissues. Wood ray cells are generally in the radial direction, perpendicular to the main wood tissues so these ray cells will generally have a maximum level of microwave energy absorption with the E vector is oriented in the radial direction. Therefore, when the orientation of the E-filed vector is modified from perpendicular to the wood surface to parallel to the surface wood, the absorption of the wood increases. Therefore, the system and method of the disclosed technology in certain embodiments can control the directional component of the E-field when applying microwave energy between the preferable perpendicular direction to the wood surface and parallel direction to the wood surface, depending on the desired results.

It is appreciated in the art that the moisture content of wood (MC) is expressed as the weight of water present in the wood divided by the weight of dry wood-substance. For example, a 30 lb. board with 10 lb. of water and 20 lb. of dry wood-substance has a MC of 50%. MC of wood may even be great than 100% because the weight of water in the wood can be greater than the weight of the dry wood-substance. Freshly cut wood may have a MC as low as 30% to as high as 250%. When wood is dried, it should be dried at specified rates to prevent degradation of the wood including of its core region. Therefore, efficient drying processes that effectively target the regions of the wood at the proper heating settings, are desirable to reduce unnecessary waste of environmental resources such as timber.

Figure 3:
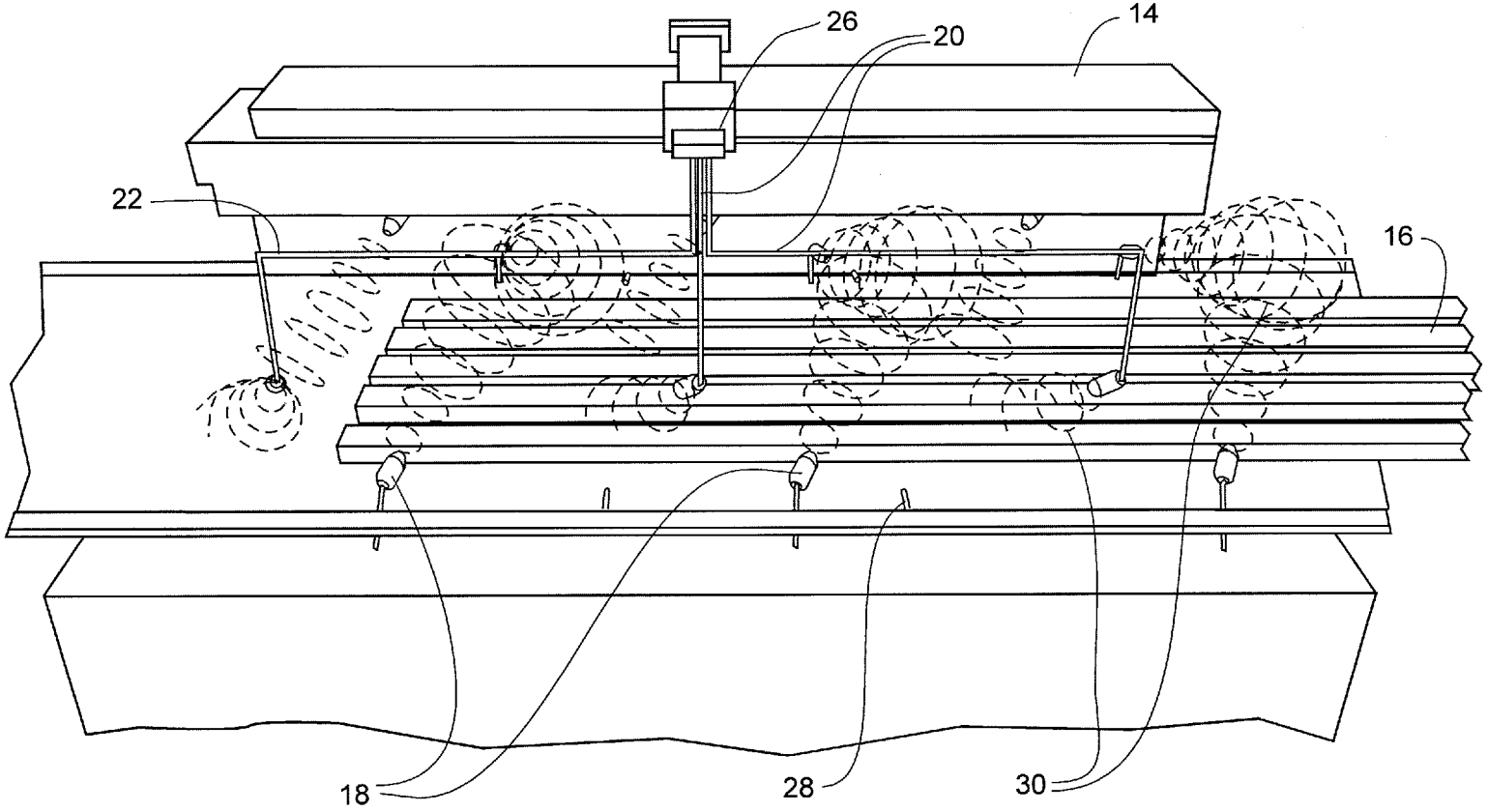
FIG. 3 is a pictorial representation of a still shot of the apparatus and of the dimensional lumber as it travels to the left on a conveyor belt of the system shown in FIG. 2.

As shown in FIG. 3, in one embodiment, dimensional lumber 16 is loaded onto the conveyor belt 12 (from the right of the figure shown) for translating (to the left in the figures) through the enclosure 14. As the lumber 16 translates through the enclosure 14, it is preferably heated evenly by microwave radiation 30 delivered by nozzles 18 positioned on either side of the conveyor belt 12. In certain embodiments, the nozzles 18 may be configured as jet nozzles positioned in space between adjacent waveguide sections. The nozzles 18 may also be positioned along opposing waveguide sections. In other embodiments nozzles 18 may rotate in a sweeping motion along the length and across the width of the dimensional lumber 16 as it translates along the conveyor belt, preferably uniformly irradiating and heating the lumber as it passes through the enclosure 14. Assuming a nozzle is positioned at 0 degrees when it is perpendicular to the conveyor belt, each nozzle preferably has a range of motion of at least +/−45 degrees along the length of the enclosure 14, or up to almost +/−90 degrees for a full 180 degree range of motion.

The conveyor belt 12 can be formed of any suitable material, such as a plastic that is inert to microwave radiation.

The microwave radiation 30, which penetrates and heats the lumber, can be generated by any suitable source of microwave and is preferably directed to the nozzles 18 through appropriately sized and shaped channel waveguides 20 running lengthwise along the enclosure. It should be noted that though only one layer of dimensional wood 16 is shown on the conveyor belt in the figures, it is contemplated that several layers can be stacked, with or without spacers, for treatment at one time, with the appropriate placement of additional microwave emitters. Accordingly, as shown particularly in FIG. 3, the nozzles 18 can be positioned along both an upper waveguide channel 22 which may transition to known mediums such as cable or coaxial mediums, and directed downward for heating the dimensional lumber 16 and also along a lower waveguide channel (not seen in the figure) and directed both horizontally and downward as in the figure shown, or also upward for radiating through a stack of the dimensional lumber 16. Additional waveguide channels and nozzles can be appropriately placed at various levels for uniformly heating several layers.

Additionally, jet nozzles are included in certain embodiments to deliver levels of air streams to the material as determined by the respective nozzle's head, the shape of the nozzle and the size of the mouth of the nozzle. These jet nozzles may be included in certain embodiments to supplement the delivery of microwave energy to the material being dried by sweeping moisture away from the surface by delivery of bursts of air streams. The jet nozzles may deliver air streams and furthermore, be configured to deliver high velocity gas streams formed from gases at surface moisture removal points of the drying process. These nozzles are configurable to target a certain level of moisture from the surface of the material undergoing the disclosed drying process.

In the embodiments shown in the FIGS. 2-5, three sets of nozzles 18, which may configured to be rotating nozzles, are provided for evenly heating the lumber with microwave. Each set includes four nozzles: a pair of upper nozzles, each upper nozzle positioned on either side of the conveyor belt 12, and a pair of lower nozzles, each positioned on either side of the conveyor belt 12.

Any known continuous microwave source can be used for delivering the microwave radiation to and through the waveguides. For example, the microwave generator (not shown) can be a stand-alone unit which includes a magnetron, for example, a 150-kW magnetron, electromagnet, power supplies, and additional components such as isolators for protecting the magnetron from back-reflections. Referring to FIG. 3, additional components are preferably included for selectively directing a desired range of microwave radiation through a designated opening in a manifold 26 to the waveguides 22 interior to the enclosure 14.

The waveguides 22, manifold 26, and nozzles 18 can be formed of any appropriate material, such as aluminum, copper, stainless steel or brass.

It is also contemplated to use solid state microwave emitters known in the art rather than the magnetron system shown.

The sets of nozzles 18 are preferably evenly spaced as needed along the length of the enclosure 14 to rapidly and evenly heat and evacuate moisture from the lumber during a heating cycle. As the lumber is heated by the microwave radiation 30 emitted by the nozzles 18, moisture is transferred from the central areas of a layer (or stack) of dimensional lumber 16 to the outer surfaces of the wood. Removal of the moisture is preferably continuously achieved by circulating air through the enclosure 14 according to any method known to those of ordinary skill in the art. For example, exhaust fans can be appropriately placed to draw air in through one or both ends of the enclosure, creating an air flow along the length of the conveyor belt. Preferably, a circulating air system is used such that the temperature and humidity of the circulating air can be regulated in real-time to maintain a preferred moisture profile of the lumber in accordance with methods known in the art.

Referring to FIG. 3, in one embodiment, microwave radiation is uniformly applied to heat the portion of the lumber in the enclosure 14 for a period of time and with sufficient intensity to heat and vaporize moisture within the lumber, preferably within a central portion of the lumber, without significant destruction to the ray cell tissue of the wood. The microwave radiation is then interrupted, for example, by modulating, or switching off, the source of microwave, or otherwise mechanically diverting or blocking the radiation from impinging on the wood, to provide a drying (and cooling phase). In certain embodiments of the disclosed system, a drying (and cooling) phase is associated with the microwave cycle. The cycles may operate simultaneously or at certain time delays depending on the moisture levels detected by the sensors of a moisture sensing unit.

Moisture is removed from the surface of the lumber during the drying phase by any known method known in the art, such as by circulating air. The drying phase preferably continues for a period of time that is determined by at least one of a number of constantly monitored parameters, such as change in the overall moisture content of the wood, or in the uniformity of a moisture profile within the wood. The microwave heating and drying phases are continued to remove moisture from the lumber, preferably, until a desired final moisture content is achieved.

In various embodiments, the intensity of the microwave heating of the lumber is preferably maintained at a level that avoids substantial destruction of the ray cells and wood tissue, preferably, not greater than about 10 $W/cm^2$.

In other embodiments, the intensity of the microwave heating is raised for at least a portion of one or more heating phases to a range of between about 10 $W/cm^2$ and 1 $kW/cm^2$.

In certain embodiments, the heating phase includes the application of microwave radiation to the lumber for a period of time from about 20 seconds to about 40 seconds. In additional embodiments, the drying phases can range from about 30 seconds to a minute.

In still other embodiments, the heating phase includes the application of microwave radiation to the lumber for a period of time ranging from about 0.1 seconds to about 700 seconds.

It is understood that each subsequent heating and drying phase can be of differing duration, preferably as determined by monitored parameters, such as the continuing moisture content and profile measurements.

In various additional embodiments, the microwave frequency for heating the wood is maintained in a range of between about 0.1 GHz and 300 GHz, more preferably, between about 0.1 GHz to about 24 GHz.

In one embodiment, the microwave frequency is maintained between about 2 and 3 GHz, preferably around about 2.45 GHz.

In one embodiment, the microwave frequency is maintained in a range between about 750 MHz and 1.2 GHz, preferably between about 850 MHz and about 950 MHz. In other embodiments, also depending on the type of porous or otherwise fibrous material being treated and the currently detected moisture levels of the material, an applied microwave frequency may range from 500 MHz to 10 GHz, preferably 2450 MHz or 915 MHz in a continuous process. Any applicable international standards may also be indicative of the applied ranges as well.

The systems and methods of the present disclosure are particularly well-suited to drying dimensional lumber. In typical applications well-suited to the continuous process of the disclosure, the lumber can be from about ¼" to 3" thick, 1" to 12" wide, and 1 to 24 feet in length.

As one example, 1" thick×3" wide×40" long strips of dimensional lumber were dried in about 20-30 sec under 37 kw microwave radiation for example, at 915 Mhz, is uniformly delivered over the lumber within the enclosure.

It is understood that the intensity of the microwave needed to penetrate a predetermined thickness of the lumber will increase in accordance with the moisture content. In other words, as the moisture content is reduced after each heating cycle, the intensity of the microwave is also preferably reduced to prevent unwanted damage to the wood. It is also understood that the penetration depth of the microwave is a function of the frequency as well as of the properties of the wood, including moisture content. Accordingly, the moisture content of the lumber is preferably monitored throughout the process in accordance with methods well-known in the art and used to adjust the various operating parameters to tune the parameters of the microwave source for optimal performance during the process and, preferably, to vaporize moisture throughout the entire volume of the wood.

It is also desirable to control the orientation of the electric field strength vector E of the microwave radiation. As one of ordinary skill in the art will appreciate, the penetration depth will also depend on the orientation of the electric field vector impinging on the lumber and on the relative orientation of the electric field strength vector relative to the grain of the wood. In one embodiment, the orientation of the electric field is preferably roughly aligned parallel to the grain of the wood. It is also appreciated that the orientation of the E field vector may differ using a single-mode applicator waveguide, the waveguide being the single applicator. In such mode the orientation of the waveguide determines the orientation of the electric field, either in a parallel direction or perpendicular orientation with respect to the material being dried. In certain embodiments, a series of waveguides can be oriented in a preferred direction for the orientation of the electric field (for example, parallel or perpendicular) and oriented in the opposite direction for the alternate orientation of the electric field. The drying process is affected by mining the electric field with uniform distribution of the microwave field, which mining is also dependent on the material being dried and the desired level of drying. In multi-mode field chambers, the E-field vectors are mixed. For example, at 915 Mhz would not produce as much mixing of E-field vectors. Another example is at 5.8 Ghz, the chamber would experience a typical multi-mode. For any cavity that is larger sized or larger than the cross-sectional area of the waveguide, the field will begin to spread and mixing of modes generally occurs. In such cases, when mixing of modes occurs, some E-fields are oriented parallel or perpendicular to the material and some even dispersing at different angles. The disclosed drying process mines the electric field such that the microwave field is uniformly distributed which results in a more ideal drying process.

In other embodiments, the orientation of the electric field is preferably aligned perpendicular to the grain of wood. In still other embodiments, the orientation of the electric field is rotated either from one heating phase to another, or during a single heating phase, from a perpendicular to a parallel orientation.

In another embodiment, an RF heating and moisture equalization is initiated either before or after the application of the microwave radiation, and before a drying phase. In a preferred embodiment, the RF heating is applied in combination with the delivery of microwave energy. Though not shown in FIG. 3, one of skill in the art will appreciate that volumetric RF heating can be applied to heat the lumber within the enclosure by energizing electrodes positioned on either side of the conveyor belt (or above and below the lumber on the conveyor belt). It will be appreciated that such RF heating will tend to equalize the moisture levels. Accordingly, in one embodiment, microwave heating is applied to preferentially heat, for example, a central portion of the lumber, by proper control of the operating parameters of the microwave, followed by application of RF heating to draw the moisture quickly to the surface, which is in turn followed by a drying phase.

Figure 4:
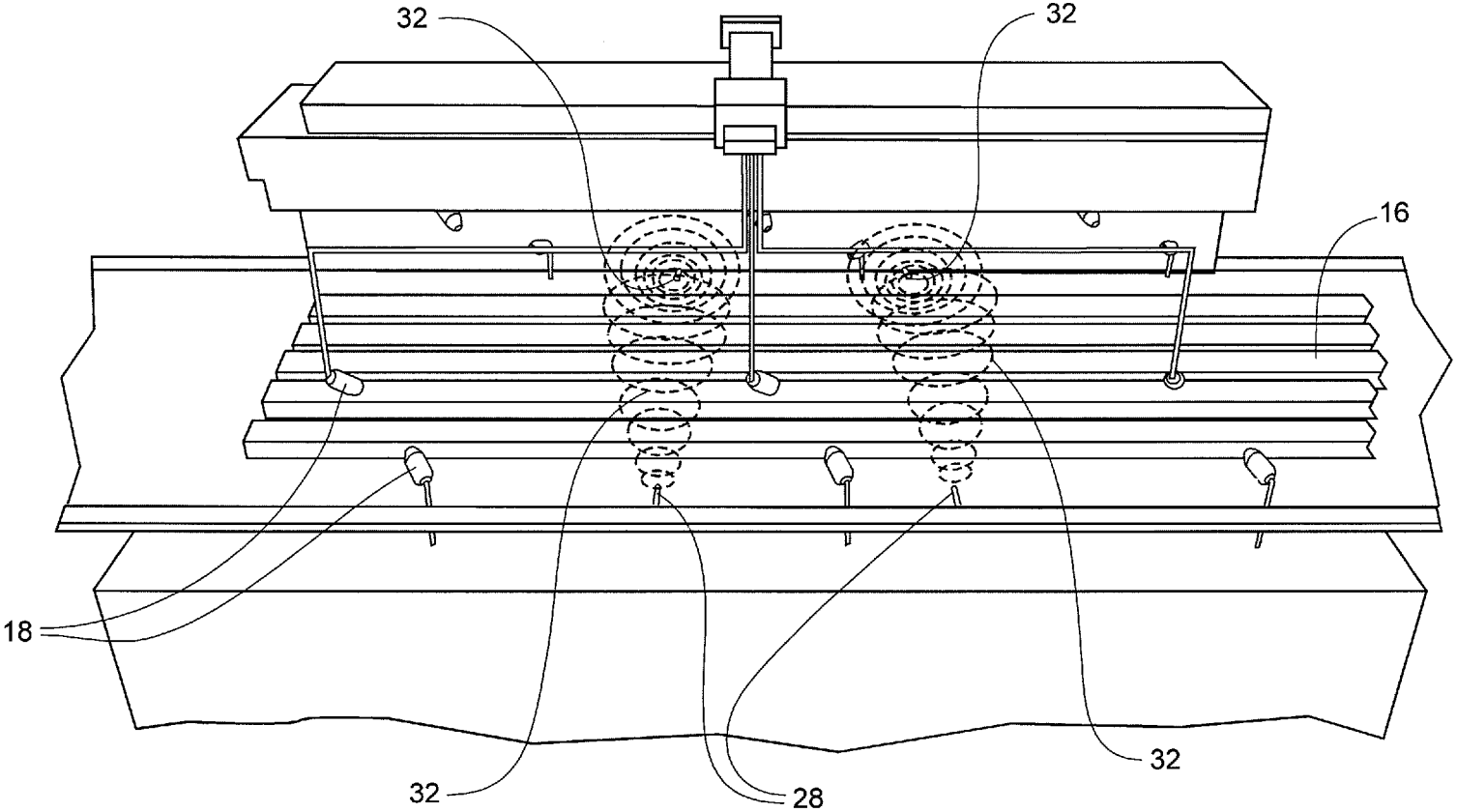
FIG. 4 is a pictorial representation of another embodiment of a system of the present disclosure.

In certain embodiments, the heating phase includes a series of RF pulses that accompany the microwave heating, followed by a drying phase. Referring to FIG. 4, for example, in one embodiment, during a heating phase, which can be, for example, between about 10 sec and 600 sec in total duration, the microwave heating of the portion of the lumber inside the enclosure 14 as shown in FIG. 3 is accompanied by RF pulses generated by opposing RF electrodes, RF plates or emitters 28.

In certain embodiments a dielectric material can be applied or deposited to the inner walls of the chambers, such as the chambers (604) and (613) shown in FIG. 6A and described in greater detail below. For example, a dielectric material such as carbon fiber, ceramic material, synthetic resin material, silicon carbide or silicon carbide composite can be applied to the inner wall of the drying chamber. An exhaust module with a vacuum pump system can also be included to prevent unwanted moisture condensation in the drying chamber. The dielectric materials in turn generate heat when microwave energy is applied. This can provide some additional radiant heat to the outer surface of the material being heated and can thereby serve to dry the moisture drawn to the outer surface of the actual material being heated.

In one embodiment, the operating parameters of the microwave source are preferably optimized to preferentially heat a central portion of the lumber. The RF is then applied to equalize the moisture profile while simultaneously continuing the heating process to quickly draw the moisture out to the surfaces of the lumber. Preferably, circulating air continuously removes moisture from the lumber even during the heating process. Accordingly, unlike prior art systems that employed microwave drying, moisture can be efficiently and quickly evacuated away from the surface of the lumber and out of the enclosure as it is evacuated, not after it forms a barrier on the surface to further irradiation. As a result, a fairly uniform moisture profile is maintained, similar to traditional cycling of the charging and discharging cycles of traditional kiln drying, but at a much faster rate. In addition, the expense and inconvenient batch process of known RF kilns is avoided, and no defects are imparted to the wood in the process.

In one embodiment, the RF pulses are of a duration in the range of between about 0.5 seconds and about 20 seconds, and can also be separated by between about 0.5 seconds and about 20 seconds. Preferably, air is circulating throughout the entire process to continuously draw the moisture away from the wood as it is vaporized and transported to the surface. However, a drying cycle also preferably follows during which no microwave or RF heating is applied.

In any of the embodiments, drying/cooling cycles during which there is no RF or microwave radiation can also be provided between heating cycles and may be between 30 seconds to a minute long, or up to about 10 minutes long and can be determined based on the constantly monitored parameters of the wood, circulating air, and internal environment of the enclosure.

In addition, a final drying/cooling stage which is substantially longer is also preferred, which can last anywhere from two (2) hours to three (3) days or longer as needed.

Referring again to the example shown in FIG. 4, the electrodes 28 for RF heating are appropriately sized to heat two separated rectangular sections of the lumber as it translates down the conveyor belt. It is appreciated that one of the ways to control RF heating is the manner in which the RF plates or electrodes are coupled, particularly by changing the distance between the electrodes. Therefore, a pair of electrodes are positioned on either side of the conveyor belt (i.e. anode and cathode plates) and an E-field is produced between the plates. The distance between the plates controls the level of RF energy that is applied to the material or load on the conveyor belt. In a preferred embodiment, the performance of the electrodes can be optimized and further controllable, by making one of the plates movable and the other plate set at a particular distance apart. A motorized device set behind the second plate is able to move the second plate closer or further away from the conveyor belt, and thus optimizing the RF drying process for the material being dried. This ability to move one of the pairs of electrode plates minimizes the air gap and reduces any incidence of arcing (eg. burning of the product and/or the electrode). In a preferred embodiment, the RF plates or electrodes are situated as close to the product and the current is adjusted as accomplished by adjusting the RF generator, also dependent on the dimension of the material being treated. With a larger product, there would generally be a wider distance between the electrodes.

Preferably, the RF pulses are generated in a frequency range of between about 2 and 30 MHz.

During the microwave/RF heating, the temperature of the lumber may be from about 100 to 250 degrees Celsius, depending on the type or wood.

Figure 5:
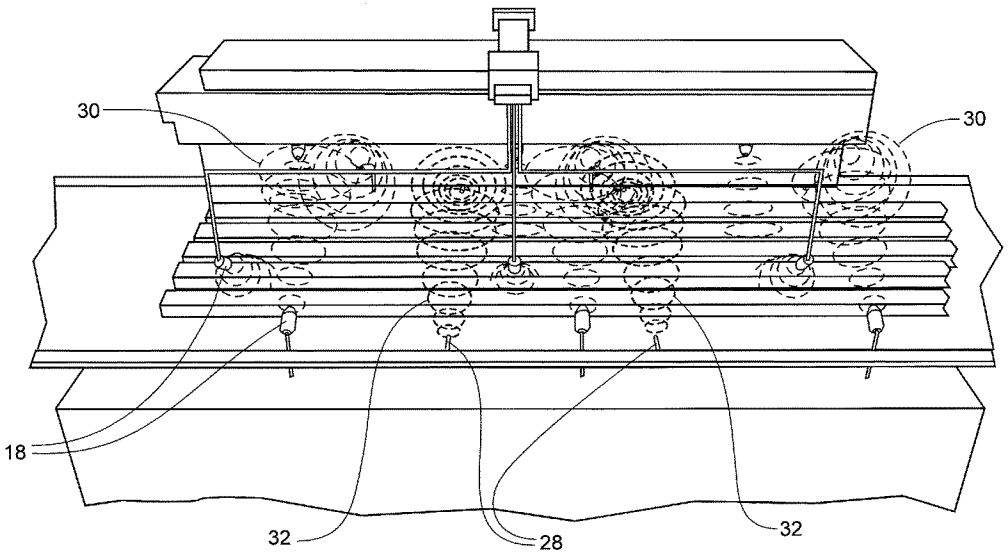
FIG. 5 is a pictorial representation of yet another embodiment of a system of the present disclosure.

In an alternate embodiment, rather than uniformly heat the entire portion of the lumber that is inside the enclosure 14 at any one time with microwave, only a portion of the lumber is irradiated with microwave 30 as it is translated on the conveyor belt, as shown in FIG. 5.

In additional embodiments, the enclosure is also injected with nitrogen to help evaporate the moisture off the lumber.

For example, the sets of nozzles 18, can be configured to sweep back and forth transverse to the direction of the conveyor belt to generate a number of rectangular swaths of radiation for heating a portion of the lumber. The rectangular swaths of microwave radiation are separated by a fixed distance. The nozzles 18 are staggered between pairs of opposing electrodes 28 along the conveyor belt for the application of RF to each portion of lumber as it translates along the conveyor belt. Accordingly, alternating rectangular swaths of microwave radiation and of RF heating are provided. Additional rectangular drying regions can also be provided along the conveyor belt that are not heated by either microwave or RF to provide drying or cooling "stations." Additional fans and vents could be placed to preferentially circulate air over these regions.

Accordingly, the periods of time corresponding to the RF heating, microwave heating, and drying can be controlled by the speed of the conveyor belt, the length of the rectangular swaths in the direction of the conveyor belt, the separations between the rectangular swaths, and, optionally, also by controlling the periods of time during which each of the microwave and RF emitters are energized.

In various embodiments, the nozzles 18 of the present disclosure have an adjustable shape and length for altering the emitted radiation pattern and intensity profile in the dimensional lumber as needed.

In any of the embodiments of the present disclosure, various parameters of the dimensional lumber 16 are monitored continuously as the lumber translates along the conveyor belt. Measurements of these parameters are preferably used in a feedback loop to adjust any of the operating parameters of the system 10. For example, the moisture content and gradient in the lumber can be monitored using various in-line moisture meters known in the art, and various humidity and temperature monitors can be positioned throughout the interior of the enclosure 14 to monitor the environment. The humidity and temperature of the air circulating into the enclosure 14 can be adjusted accordingly to maintain operable conditions for heating and drying the lumber. In addition, the intensities and radiation wavelengths of the continuous microwave and of the RF interceptor can also be controlled in accordance with the parameters that are monitored, as well as in accordance with the type, starting moisture content, and volume of material that is being treated.

As one example, power amplifier technology for RF heating systems can be used as both a sensor for the moisture content of the lumber and for subsequent control of the RF power.

To accommodate different ranges of microwave radiation, the system 10 can also include additional sets of microwave emitters and waveguides that are optimized for different wavelength regimes. The waveguides are generally fed into the cavity and the mode of excitation of the cavity depends on the size of the cavity and frequency of the microwave energy. Thus, in certain embodiments, these additional waveguides may be used with different microwave frequencies applied simultaneously. Additionally, in certain embodiments, the same or varied microwave frequencies may also be applied intermittently.

Appropriate energy guiding components selectively guide the desired microwave radiation through corresponding waveguides in the manifold. The optimal microwave and RF range can be manually chosen from a control panel by the operator upon initial setup, based on the type of wood and so on, and can optionally also be automatically adjustable during processing, based on the constantly measured parameters of the lumber and of the environment within the enclosure 14.

Figure 6A:
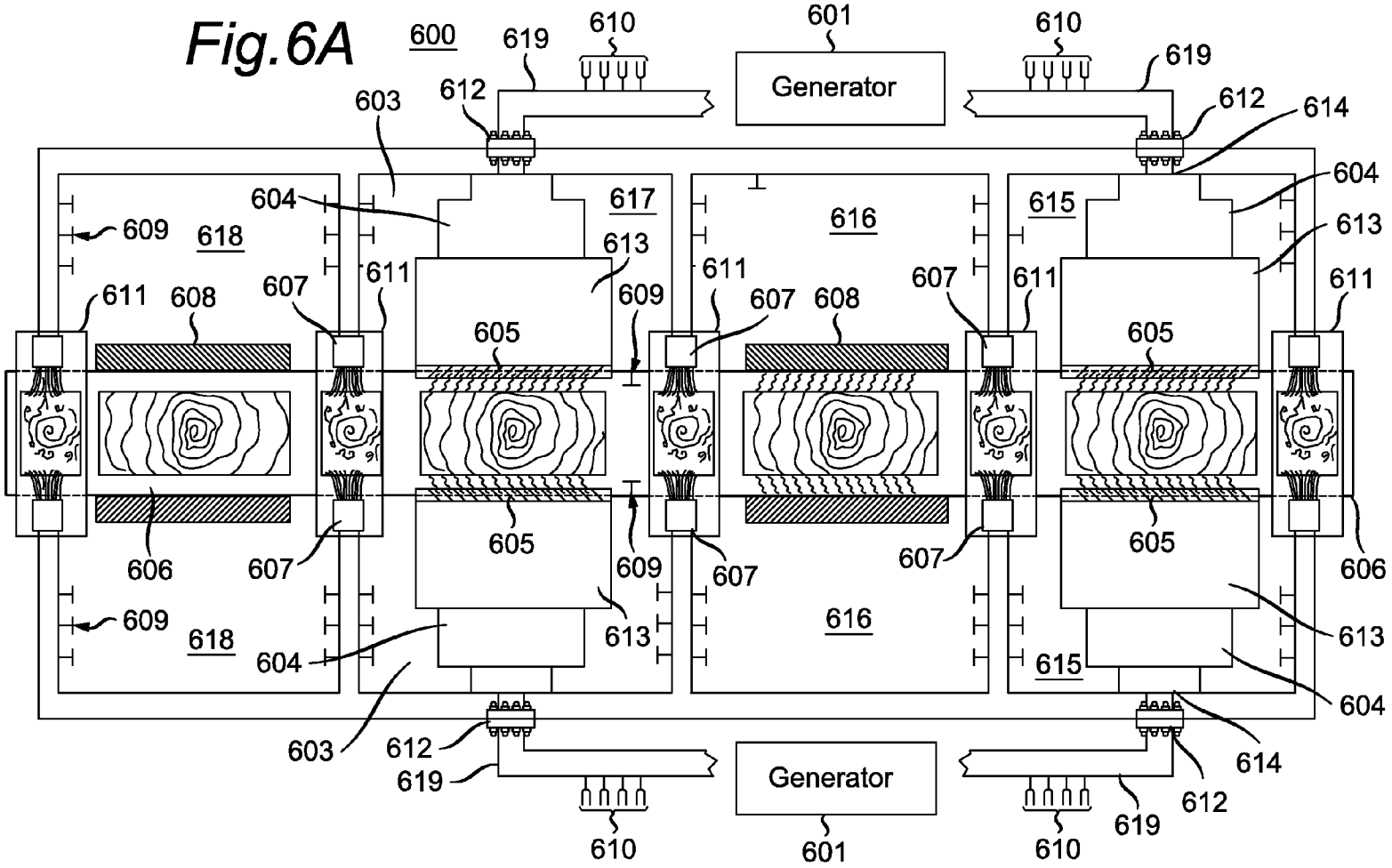
FIG. 6A is a block diagram of a preferred embodiment of a system of the present disclosure

FIG. 6A is a preferred embodiment of the present technology. A generator (601) delivering microwave energy is shown at (601). The generator (601) may be configured as a standard microwave generator, including power supply and magnetron heads for operation at varied levels. For example, a 915 MHz generator operates with power ranges up to 100-150 KW, a single 2.45 GHz generator operates at levels of up to approximately 30 KW and a 5.8 GHz generator operates at a power level of approximately 700 W. In certain embodiments, multiple generators may be implemented at certain operable frequencies. Typically, the microwave power supply can be stand-alone with magnetron heads that can be integral to or remotely situated from the power system. Other custom configurations are also possible including configurations that are suitable for power supply systems implemented in international environments.

In a preferred embodiment of the disclosed system and method, the microwave generator (601) having a power of 150 KW can be split four ways in certain embodiments. Four waveguides (619) are shown in the FIG. 6, adapted to extend with the waveguide (619) flanges that can extend with varied lengths. Generally, hollow conductive metal pipe is used to carry high frequency waves, particularly microwaves. The waveguides (619) are sealed and connected to the respective openings of the each chamber (614) at connection points (612). The microwave energy is introduced into the first chamber (613) via opening (614). The energy is dispersed within chamber (613) while a dead zone or microwave attenuation area is formed surrounding the first and second chambers (613, 604) at surrounding portions of chamber 1 (604) and chamber 2 (613) as shown in zone areas (603). It is noted that the microwave attenuation areas or zones (603) are purposely created to serve the purpose of preventing microwave energy from entering, for example, the RF zones (616) and (618). This permits among other advantages, greater control over the drying process including specific targeted heating depending on the mode of operation and the type and cut of material being dried. Chamber 2 (613) permits the applied energy to be better focused and target. In addition, Chamber 2 (613) permits the system to maintain better control over the applied energy levels without as much dispersion.

The microwave energy is directed to the second chamber (613) within a close range distance of the wood or material as it passes along the conveyor belt along zones (615) to (618). This in effect controls the distance of the microwave energy applied to the material or wood being dried. The benefit over existing systems is the ability to exert greater control over the distance, direction and rate of penetration of the microwave energy as delivered to the wood or material being processed and dried. Any inefficiency associated with prior art systems that merely apply microwave energy to material being dried, are thereby eliminated. Such conventional systems typically experienced greater dispersion of microwave energy. The energy in the disclosed embodiment is not as greatly dispersed but, rather the levels controlled and applied to the materials with greater ability to intelligently target areas of greater moisture. This prevents greater amounts of dispersion of microwave and/or RF energy including the power generally associated with such applied energy. In effect, the energy emitted into the second chamber (613) is better targeted and the disclosed embodiment can maintain better control over the energy level without as much dispersion of energy.

Figure 6B:
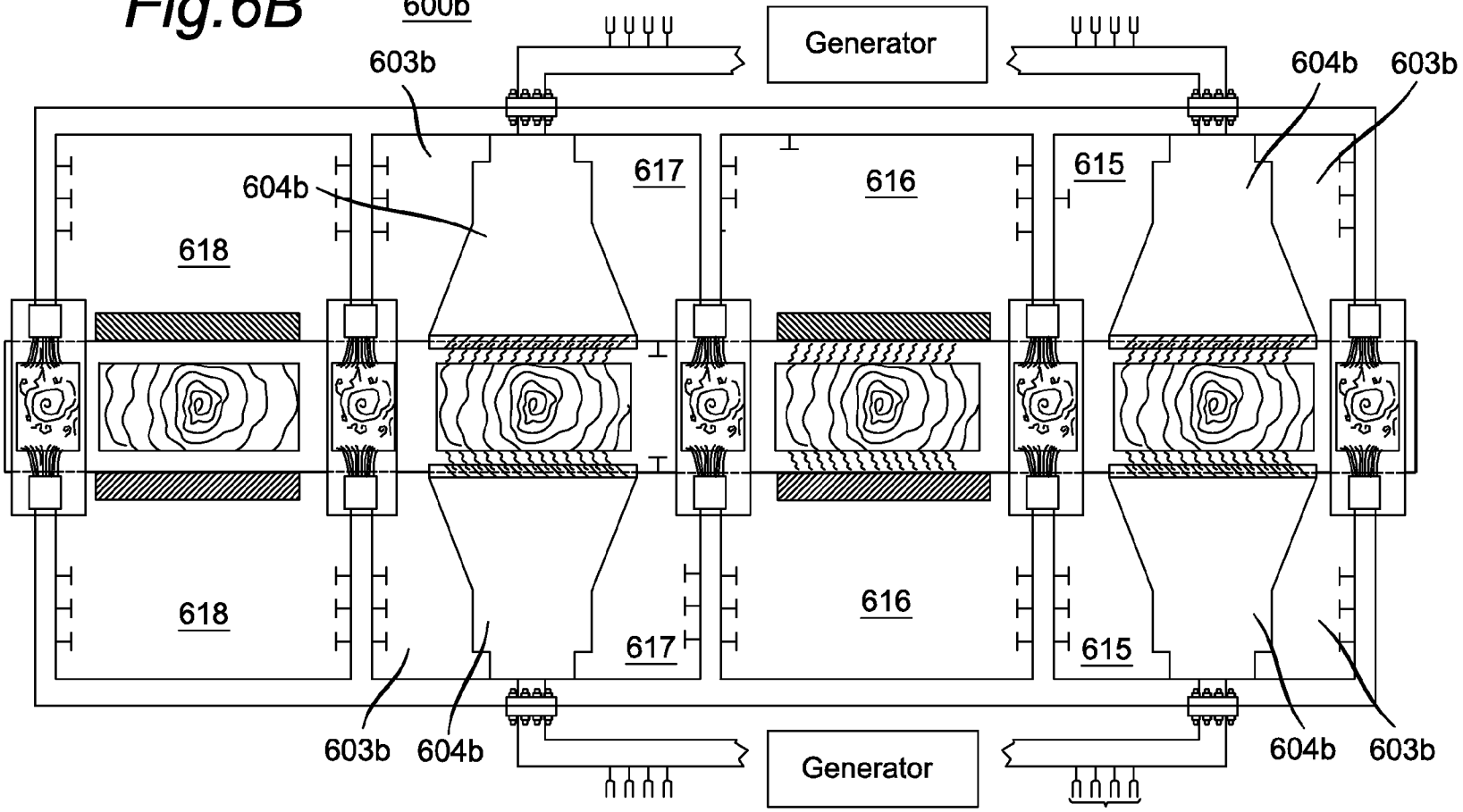
FIG. 6B is a block diagram of an alternative embodiment of the system of the present disclosure.
Figure 6C:
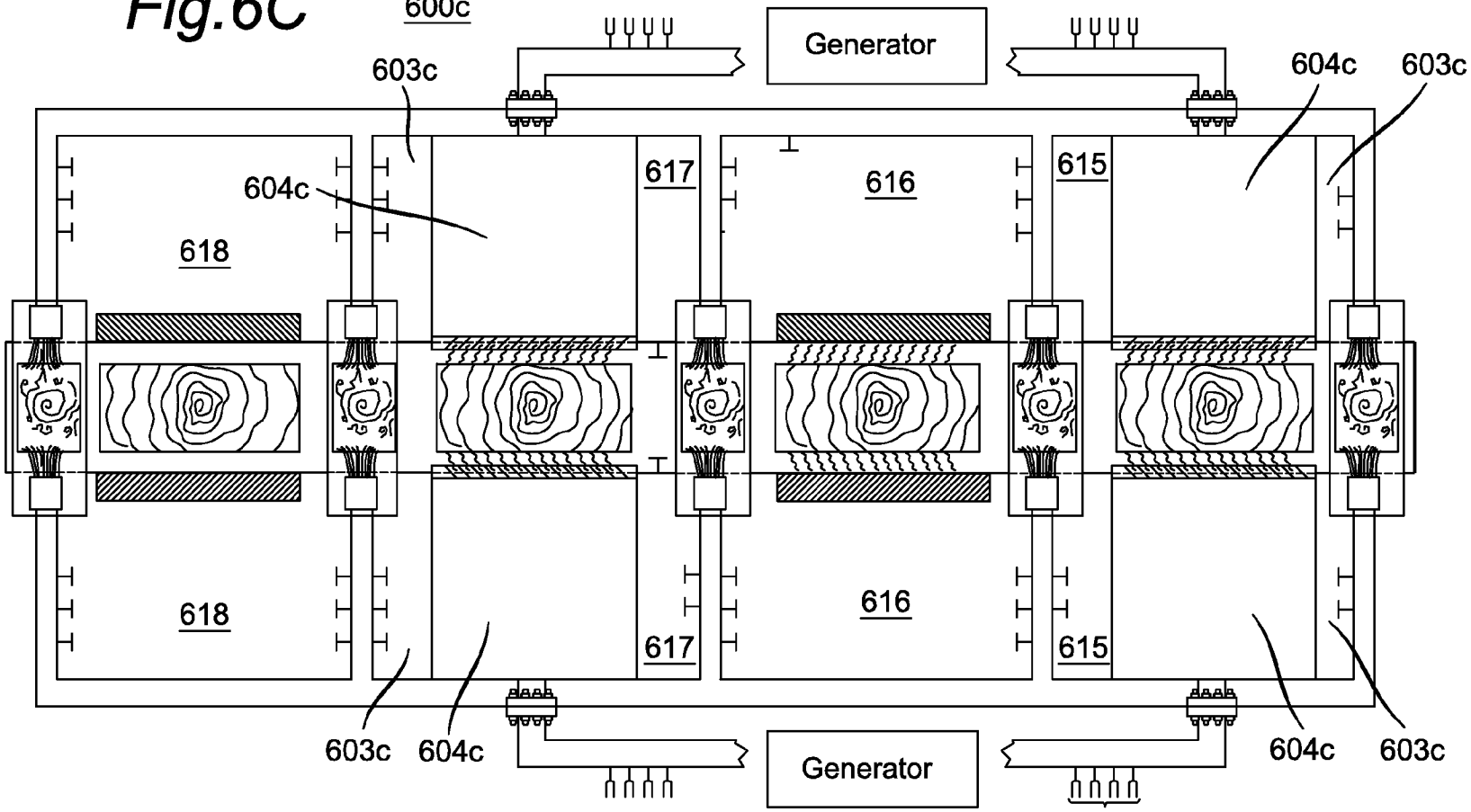
FIG. 6C is a block diagram of an alternative embodiment of the system of the present disclosure.
Figure 6D:
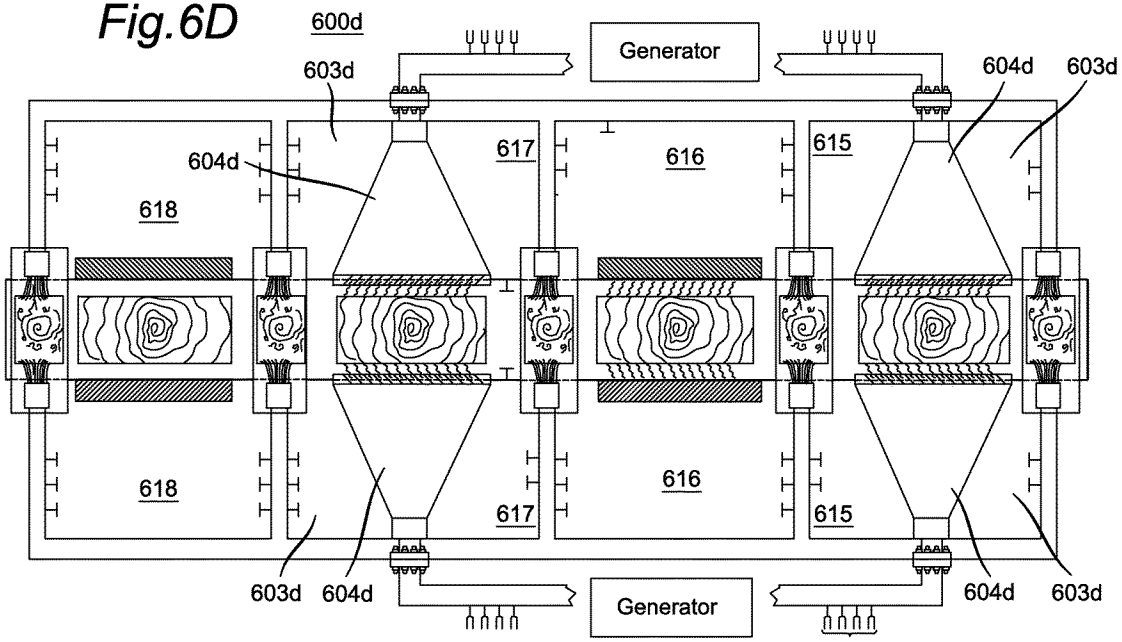
FIG. 6D is a block diagram of an alternative embodiment of the system of the present disclosure.

It is noted that the specific dimensions and shape of the chambers may affect the targeted delivery of the energy as shown in FIGS. 6B-6D (elements 604(*b*) through 604(*d*)) with surrounding microwave attenuation zones (elements 603(*b*) through 603(*d*)) varying also based on the shape of the surrounding chambers (604(*b*)-604(*d*)). The targeted delivery of energy also depends on the type, cut and/or dimensions of the material as well as the uniformity of the applied microwave field. The chambers are designed in certain embodiments to control and focus the microwave energy and promote optimal coupling with the material or load. Additionally dielectric materials such as for example, silicon carbide, carbon, carbon containing resin or carbon fiber, can be used to coat the interior walls of the chambers (604) and (613) in order to absorb any stray microwave energy.

In the shown embodiment of FIG. 6A, the first chamber (604) is used essentially to dissipate the microwave prior to the microwave energy impacting the RF portion. In certain embodiments, the microwave and RF signals may also be combined in one or more of chamber 2 (613) by including opposing RF electrodes in or near the conveyor belt at zones (615) and (617).

It is noted that chokes (609) are included throughout the chambers in order to prevent impedance or blead-off. The impedance brushes (607) and/or chokes (609) comprising for example, silicon carbide, carbon, carbon containing resin or carbon fiber, may be used to absorb or mop-up any stray microwave energy. Additionally such brushes (607) and/or chokes (609) can cause the microwave energy to be reflected back and/or essentially cause the microwave energy to cancel itself out. The impedance brushes (607) may be located either under the conveyor belt (606) or above the conveyor belt, brushing the surface of the conveyor belt (606). The impedance brushes may be located in the same region as the moisture control device (611) are radiation absorbers to prevent unintended impedance. Chokes (609) such as for example, pins, ¼ wave, cut-off or tube chokes, can also be used to separate and isolate chambers from any neighboring irradiation and prevent any impedance blead off. Chokes (609) are generally situated in the dead zone areas or microwave attenuation zones (603) situated before and after any of the impedance brushes (607) and/or surrounding the areas of the chambers.

The wood boards, ceramic slabs or other materials that have retained or absorbed some level of moisture, are loaded onto the conveyor belt (606). As the board first passes for example, from right to left, from zone 615 to zone 618, the material first passes underneath the moisture control device (611) in zone 615. In certain embodiments, this scanning is accomplished using x-ray, laser, or other known scanning device. The moisture content is processed by a computer processor within moisture control device (611), for example. The computer processor may scan the board every nanosecond and determines whether for example, the detected levels of moisture require additional exposure to microwave energy or alternatively, increasing or decreasing the speed of the conveyor belt (606). A signal to increase the speed of the conveyor belt (606) will decrease the applied energy to the material on the conveyor belt (606). A signal to decrease the speed of the conveyor belt (606) will increase the applied energy to the material on the conveyor belt (606).

It is noted that a certain distance between the moisture control device (611) and any of respective zones adjacent thereto (615)-(618) creates a zone of quiescence so that the material is not being treated with any form of energy in those areas. It is preferable to use radiation absorbers such as impedance brushes (607) to control and reduce the unintended incidence of unwanted irradiation. Chokes (609) may also be used throughout the zones (615)-(618) to separate and insulate the chambers from neighboring irradiation.

The moisture control device (611) will detect the moisture level of the material that is currently passing on the conveyor belt as the material passes through successive zones, namely (615)-(618). The moisture control component (611) may include moisture and temperature detection sensors that send an electric signal to the tuning forks (610) such as for example, stub tuners, transmitting the detected temperature and/or moisture level of the material. The tuning forks (610) in turn, may send a signal to the louvers locations at elements (605). The tuning forks (610) make an adjustment inside the waveguides (619) changing the harmonics of the microwave energy as emitted to the chambers and subsequently, as emitted to the material moving along the conveyor belt (606). The tuning forks (610) function to more effectively couple the microwave energy into the load or material and minimize the reflected power. The tuning forks (610) may change the impedance of the microwave energy to better match the level of the load. The moisture control device (611) may also interface with the microwave generator (601) controls, such as for example, a PID interface and controller connected thereto that can adjust the power of the microwave energy upon receipt of a signal to either increase or decrease the power of microwave energy. An automatic stub tuner may be implemented in certain embodiments with fully integrated feedback model to send appropriate signals to increase or decrease the impedance of the microwave energy and/or signal the microwave generator (601) to increase or decrease the power of the microwave. Such stub tuners may be implemented with microprocessor controllers.

The processor or moisture control module (611) may also send at least one signal to the louvers (605). The sensors may be of any known in the art such as optical sensors, RF sensors and/or infrared sensors. Motion detection sensors may also be included in certain embodiments to detect the speed of the conveyor belt.

Figure 8A:
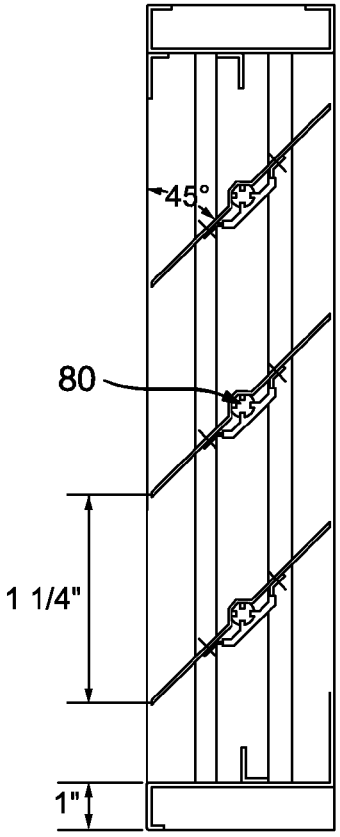
FIG. 8A is a side view of the louvers of FIG. 6, shown positioned at 45°.
Figure 9A:
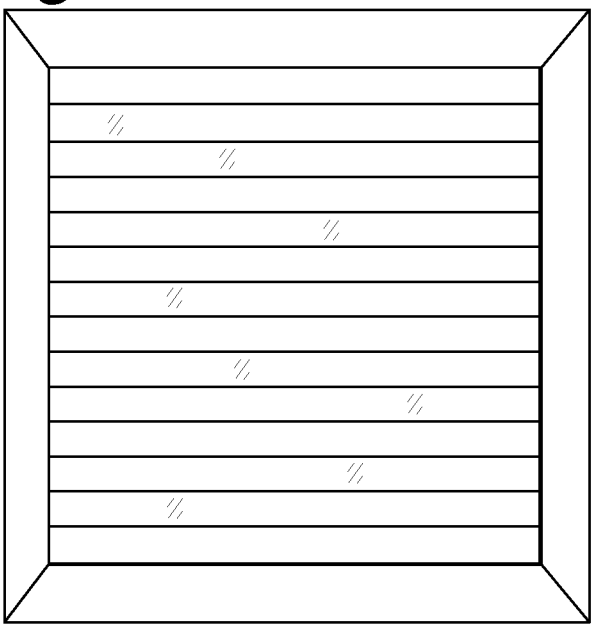
FIG. 9A is an illustration of an embodiment showing the dimensions of the louvers of FIG. 8A in a closed position.
Figure 9B:
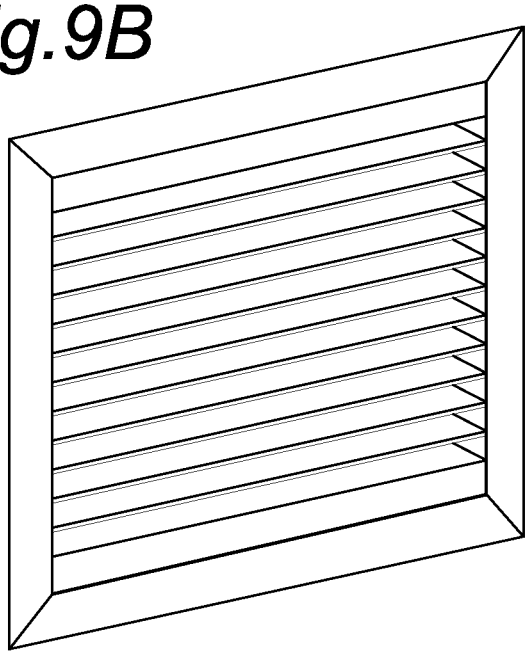
FIG. 9B is an illustration of an embodiment showing the dimensions of the louvers of FIG. 8A in an open position at 90°.

The louvers (605) which include a number of fixed or operable blades mounted in a frame, can receive a signal to rotate to an open position, up to a 90° angle. In the event, a smaller amount of energy is desired to pass through the louvers (605), the louvers (605) will receive a signal to rotate the blades from a more open position to a lower degree of rotation, such as between 90° to 45° as shown in FIG. 8A. A signal may be received to rotate the louver blades to an even lower degree of rotation from 45° to a closed position of 0° as shown in FIG. 9A. In a closed position, no energy can be transmitted and therefore, no energy is delivered to the material as its passing in the particular zone (617) or (615). The ranges of louver (605) openings is from a rotational range of 0° to 90°. The highest energy level can be transmitted is when a louver (605) is fully opened at 90° as shown in FIG. 9B. A closed position of 0° is able to block the delivery of any microwave energy as the material travels lengthwise on the conveyor belt to the next zone of energy delivery as shown in any one of zones (615)-(618).

It is noted that the spacing of the louvers (605) does not significantly interfere with application of the microwave energy in its open position at 90°. In addition, any potential arcing is minimized by fully grounding the louvers (605). Consideration of any potential for arcing is also minimized by controlling the emitted microwave field's intensity.

The speed of the conveyor belt (606) is controllable and variable based on the detected conditions of the material as it passes the zones of the conveyor belt. For example, when a detected level of moisture signal is sent to the conveyor belt controller, the controller is able to increase or decrease the relevant speed of the material as it passes the zones of energy (615)-(618). Additionally, the variable of delivery of energy as signaled by the moisture control device (611) to the tuning forks (610), may transmit a signal the tuning forks to increase or decrease the level of microwave energy delivered to any one of the chambers (604) drying the material at any of the particular zones (615) or-(618). Louvers (605) operate in conjunction with the tuning forks (610) to more intelligently target the areas of the material that require increased or decreased energy as the material passes in the zones (615)-(618), in particular at zones (617) and (615).

It is noted that the first location of the moisture control device (611) as the board just enters the machine, is shown in this embodiment just entering zone (615). At this first moisture control device (611) the moisture control device includes scanners, for example an x-ray scanner, that identifies the type of material, for example the cut of the wood and may also detect the moisture level. The cut of the wood includes cuts such as for example, plain sawn, rift and quarter sawn cut. In connection with the detected cut of wood, the applied microwave energy may differ. Penetration of the microwave or RF energy will differ dependent on the difference cuts of wood.

Once the material has been treated with microwave energy at zone 615, it will undergo detection by the moisture control device (611). The x-ray scanner of the moisture control device (611) is also able to adjust the emitted RF energy module or device (608) that is applied in zones (616) and (618) by sending a signal to the RF energy module or device (608). The material will next be passed along on the conveyor belt (606) to zone 616, at which time, RF energy (608) is applied to the wood or material being dried.

It is noted that the portion of the wood or material being targeting depends on the cut and dimensions of the material. In addition, the moisture levels of the material impact how the applied RF energy targets the surface or core layers of the material. RF having a lower frequency has a much longer penetration depth and generally, can heat the entire thickness of a wood board. However, microwave can preferentially heat the surface until enough water is evaporated for the penetration depth to increase (since less water is now absorbing the microwave energy), and then can heat the core. At that point, microwave can heat the interior of the board hotter than the surface (because the surface is radiating and losing heat). Also, moisture has condensed on the surface of the board, the RF generally targets higher areas of moisture and may preferentially heat the area with more water, which is the surface. Therefore, the RF energy is known to targets the outer layers of the material or wood but, has a longer penetration depth that it is known to reach the core of the material. While microwaves do provide for greater heating intensity, they have be limited by penetrating deeply enough and/or providing uniform heating. Therefore, the disclosed combination of RF and microwave heating within same or alternate zones (615-518) creates a process for more uniform heating of the material that is also capable of drying the inner core regions regardless of moisture levels or thickness and/or size of the material which variables all impact how thorough the material is dried.

The material enters the area of the next moisture control device detection device (611). Any further adjustments to any emitted microwave energy is made by a signal delivered from the moisture control device (611) to the tuning forks (610) which can adjust the microwave harmonics. In addition, the moisture control device (611) may send a signal to the louvers located in the next upcoming zone (617) in order to adjust the level of microwave delivery by adjusting the degree of opening of the louvers (605) by either increasing the opening of the louvers (605) to a maximum of 90° or decreasing to a minimum of 0° rotation. The degree of rotation of the louver will impact the angle of penetration of the microwave signal. Therefore, the system will detect the best angle of rotation of the louver (605) to reach the best level of penetration. The cycle may repeat for the length and number of zones that the apparatus may be configured to comprise and/or when it is determined that the wood or material no longer requires treatment. It is also noted that the RF energy (608), in certain embodiments may also be deliverable by solid-state RF power devices. In certain embodiments, infrared energy may also be use either in combination with RF or in separate zones in which infrared energy may also applied to the materials in order to heat the materials. Infrared radiation may also be used to remotely detect the temperature of the material. Infrared heaters may be achieved using known infrared energy sources, a heat exchanger and a fan that blows air into the exchanger to disperse the applied heat.

While particular embodiments have been described herein for delivering microwave to either the entire portion of the lumber within the enclosure or to separated rectangular swaths of the lumber using nozzles connected to channel waveguides, it should be appreciated that various other configurations for delivering microwave for heating the lumber are also contemplated. For example, slots can be provided in microwave waveguides positioned above the lumber. In what are known as a leaky waveguide configuration, appropriate microwave guides can be positioned below the slots and in certain embodiments, rotated in a sweeping motion to deliver either uniform microwave radiation to the entire portion of lumber within the enclosure, or to deliver separated rectangular swaths. Such semi-standard configuration permits the application of microwave energy to the material along the length of the waveguide via the slots configured along the length of the waveguides. In addition, various solid state emitters are known in the art which provide various additional compact solutions.

The system and method of the present disclosure advantageously replace prior art batch processing systems and methods for heating and drying materials in a kiln with a continuous processing technique. Accordingly, as dimensional lumber for example, is cut to process a particular order, it can be immediately placed in the continuous feed system and dried in as little as 15 minutes. In contrast, traditional kiln processes that provide heating by steam, hot water coils and so on can take from 10 to 30 days to complete a batch, depending on the species of wood, and the more energy-intensive and expensive RF-vacuum kilns take up to 5 days to complete a batch. Furthermore, running any of the prior art kilns at a reduced capacity increases significantly the relative cost of the final product. Finally, the microwave treatment of the present disclosure also effectively rids the lumber from pests, eliminating the need for the application of pesticides such as methyl bromide in the final product. Accordingly, the present system and method offer additional environmental benefits as already described above.

FIG. 6B is an alternate embodiment with chambers (604*b*) shaped with a narrow mouth that extends into to a wider chamber. The dead zone or microwave attenuation zone is located in this configuration surrounding the chamber at 603*b*.

FIG. 6C is an alternate embodiment with chambers (604*c*) shaped with parallel extending walls. The dead zone is located in this configuration surrounding the chamber at 603*c*. FIG. 6D is an alternate embodiment with chambers (604*d*) shaped with a narrow mouth extending radially to a wider chamber. The dead zone is located in this configuration surrounding the chamber at 603*d*. In such preferred embodiment, the shape of the chamber is known to minimize reflections within the chamber (603*d*).

Figure 7:
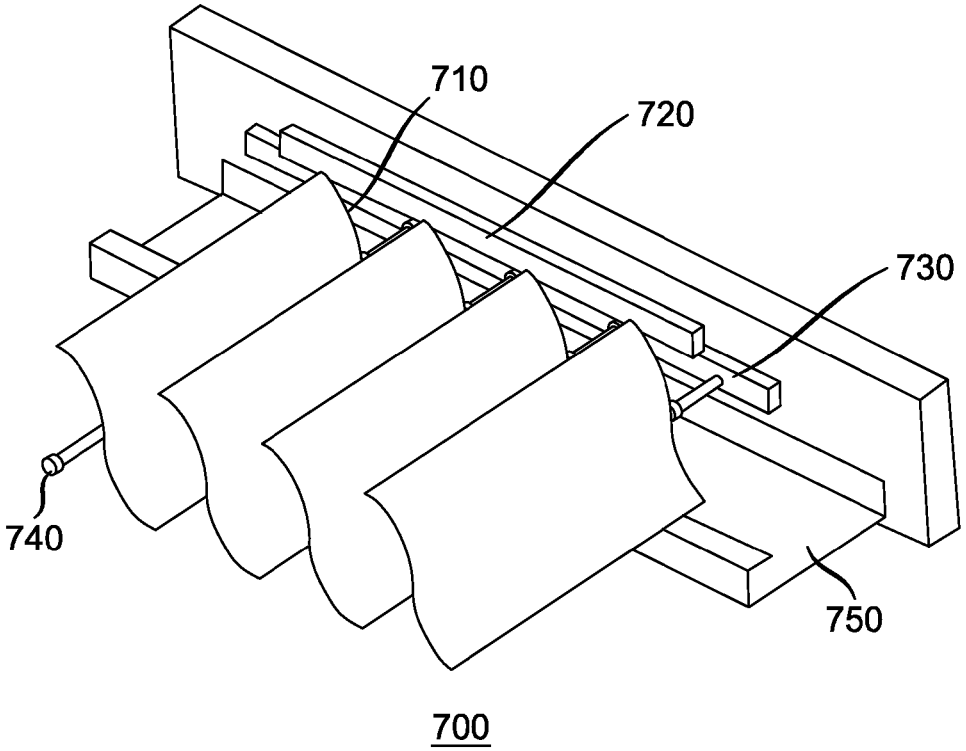
FIG. 7 is a top view of the louvers of FIG. 6, positioned at 45°.

As described above regarding the varying degrees of rotation of the louvers, FIG. 7 is a top perspective view of the louver blades (710) as connected to a rotating mechanism (740) that extends the length of the blades and is guided by element (750). The louvers (710) are attached to the louver structural supporting elements (720) and (730).

Figure 8B:
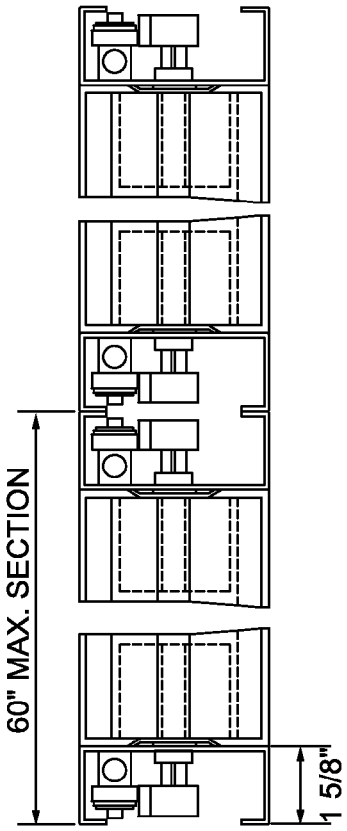
FIG. 8B is a cross-sectional view of the loevers of FIG. 8A.

FIG. 8A illustrates the louvers apparatus (800) with louvers (710) as rotated at 45° angles with respect to the x-axis or horizon. FIG. 8B illustrates a cross-sectional view of a louver (710) including the inner mechanics (810) of the rolling mechanism (80) as shown in FIG. 8A that permit the louvers (710) to rotate from 0° to 90°.

Figure 10:
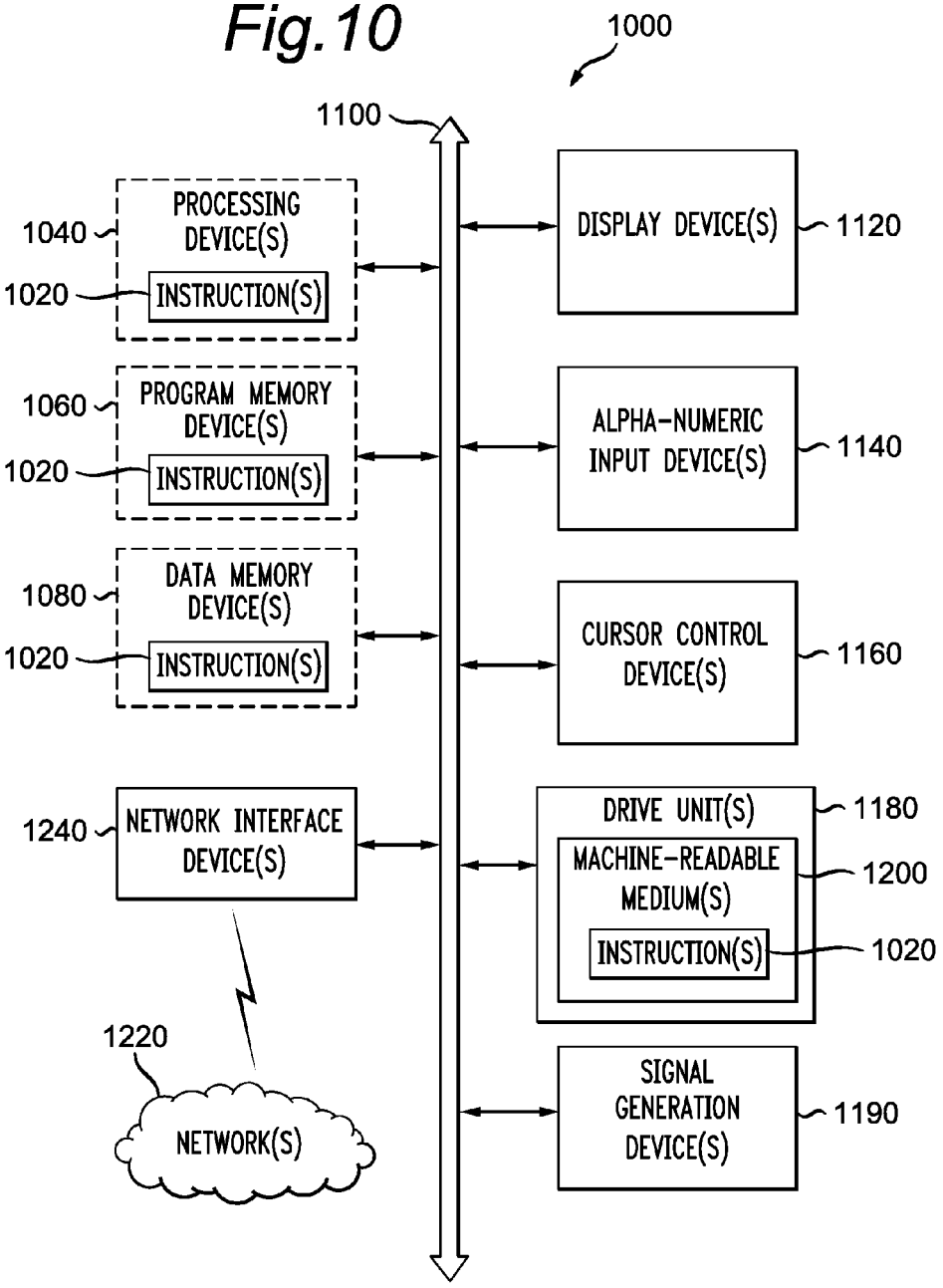
FIG. 10 is a block diagram showing a portion of an exemplary machine in the form of a computing system configured to perform methods according to one or more embodiments.

FIG. 10 is a block diagram of an embodiment of a machine in the form of a computing system 1000, within which a set of instructions 1020, that when executed, may cause the machine to perform any one or more of the methodologies disclosed herein. In some embodiments, the machine operates as a standalone device. In some embodiments, the machine may be connected (e.g., using a network) to other machines. In a networked implementation, the machine may operate in the capacity of a server or a client user machine in a server-client user network environment. The machine may comprise a server computer, a client user computer, a personal computer (PC), a tablet PC, a personal digital assistant (PDA), a cellular telephone, a mobile device, a palmtop computer, a laptop computer, a desktop computer, a communication device, a personal trusted device, a web appliance, a network router, a switch or bridge, or any machine capable of executing a set of instructions (sequential or otherwise) that specify actions to be taken by that machine.

The computing system 1000 may include a processing device(s) 1040 (e.g., a central processing unit (CPU), a graphics processing unit (GPU), or both), program memory device(s) 1060, and data memory device(s) 1080, which communicate with each other via a bus 1100. The computing system 1000 may further include display device(s) 1120 (e.g., liquid crystals display (LCD), a flat panel, a solid state display, or a cathode ray tube (CRT)). The computing system 1000 may include input device(s) 1460 (e.g., a keyboard), cursor control device(s) 1160 (e.g., a mouse), disk drive unit(s) 1180, signal generation device(s) 1190 (e.g., a speaker or remote control), and network interface device(s) 1240.

The disk drive unit(s) 1180 may include machine-readable medium(s) 1200, on which is stored one or more sets of instructions 1020 (e.g., software) embodying any one or more of the methodologies or functions disclosed herein, including those methods illustrated herein. The instructions 1020 may also reside, completely or at least partially, within the program memory device(s) 1060, the data memory device(s) 1080, and/or within the processing device(s) 1040 during execution thereof by the computing system 1000. The program memory device(s) 1060 and the processing device(s) 1040 may also constitute machine-readable media. Dedicated hardware implementations, not limited to application specific integrated circuits, programmable logic arrays, and other hardware devices can likewise be constructed to implement the methods described herein. Applications that may include the apparatus and systems of various embodiments broadly include a variety of electronic and computer systems. Some embodiments implement functions in two or more specific interconnected hardware modules or devices with related control and data signals communicated between and through the modules, or as portions of an application-specific integrated circuit. Thus, the example system is applicable to software, firmware, and hardware implementations.

In accordance with various embodiments of the present disclosure, the methods described herein are intended for operation as software programs running on a computer processor. Furthermore, software implementations can include, but not limited to, distributed processing or component/object distributed processing, parallel processing, or virtual machine processing can also be constructed to implement the methods described herein.

The present embodiment contemplates a machine-readable medium or computer-readable medium containing instructions 1020, or that which receives and executes instructions 1020 from a propagated signal so that a device connected to a network environment 1220 can send or receive voice, video or data, and to communicate over the network 1220 using the instructions 1020. The instructions 1020 may further be transmitted or received over a network 122 via the network interface device(s) 1240. The machine-readable medium may also contain a data structure for storing data useful in providing a functional relationship between the data and a machine or computer in an illustrative embodiment of the disclosed systems and methods.

While the machine-readable medium 1200 is shown in an example embodiment to be a single medium, the term "machine-readable medium" should be taken to include a single medium or multiple media (e.g., a centralized or distributed database, and/or associated caches and servers) that store the one or more sets of instructions. The term "machine-readable medium" shall also be taken to include any medium that is capable of storing, encoding, or carrying a set of instructions for execution by the machine and that cause the machine to perform anyone or more of the methodologies of the present embodiment. The term "machine-readable medium" shall accordingly be taken to include, but not be limited to: solid-state memories such as a memory card or other package that houses one or more read-only (non-volatile) memories, random access memories, or other re-writable (volatile) memories; magneto-optical or optical medium such as a disk or tape; and/or a digital file attachment to e-mail or other self-contained information archive or set of archives is considered a distribution medium equivalent to a tangible storage medium. Accordingly, the embodiment is considered to include anyone or more of a tangible machine-readable medium or a tangible distribution medium, as listed herein and including art-recognized equivalents and successor media, in which the software implementations herein are stored.

Although the present specification describes components and functions implemented in the embodiments with reference to particular standards and protocols, the disclosed embodiment are not limited to such standards and protocols.

The illustrations of embodiments described herein are intended to provide a general understanding of the structure of various embodiments, and they are not intended to serve as a complete description of all the elements and features of apparatus and systems that might make use of the structures described herein. Many other embodiments will be apparent to those of skill in the art upon reviewing the above description. Other embodiments may be utilized and derived there from, such that structural and logical substitutions and changes may be made without departing from the scope of this disclosure. Figures are also merely representational and may not be drawn to scale. Certain proportions thereof may be exaggerated, while others may be minimized. Accordingly, the specification and drawings are to be regarded in an illustrative rather than a restrictive sense.

Such embodiments of the inventive subject matter may be referred to herein, individually and/or collectively, by the term "embodiment" merely for convenience and without intending to voluntarily limit the scope of this application to any single embodiment or inventive concept if more than one is in fact disclosed. Thus, although specific embodiments have been illustrated and described herein, it should be appreciated that any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

The Abstract is provided to comply with 31 C.F.R. §1.12(b), which requires an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

In a particular non-limiting, example embodiment, the computer-readable medium can include a solid-state memory such as a memory card or other package that houses one or more non-volatile read-only memories. Further, the computer-readable medium can be a random access memory or other volatile re-writable memory. Additionally, the computer-readable medium can include a magneto-optical or optical medium, such as a disk or tapes or other storage device to capture carrier wave signals such as a signal communicated over a transmission medium. A digital file attachment to an e-mail or other self-contained information archive or set of archives may be considered a distribution medium that is equivalent to a tangible storage medium. Accordingly, the disclosure is considered to include any one or more of a computer-readable medium or a distribution medium and other equivalents and successor media, in which data or instructions may be stored.

In accordance with various embodiments, the methods, functions or logic described herein may be implemented as one or more software programs running on a computer processor. Dedicated hardware implementations including, but not limited to, application specific integrated circuits, programmable logic arrays and other hardware devices can likewise be constructed to implement the methods described herein. Furthermore, alternative software implementations including, but not limited to, distributed processing or component/object distributed processing, parallel processing, or virtual machine processing can also be constructed to implement the methods, functions or logic described herein.

It should also be noted that software which implements the disclosed methods, functions or logic may optionally be stored on a tangible storage medium, such as: a magnetic medium, such as a disk or tape; a magneto-optical or optical medium, such as a disk; or a solid state medium, such as a memory card or other package that houses one or more read-only (non-volatile) memories, random access memories, or other re-writable (volatile) memories. A digital file attachment to e-mail or other self-contained information archive or set of archives is considered a distribution medium equivalent to a tangible storage medium. Accordingly, the disclosure is considered to include a tangible storage medium or distribution medium as listed herein, and other equivalents and successor media, in which the software implementations herein may be stored.

Although specific example embodiments have been described, it will be evident that various modifications and changes may be made to these embodiments without departing from the broader scope of the inventive subject matter described herein. Accordingly, the specification and drawings are to be regarded in an illustrative rather than a restrictive sense. The accompanying drawings that form a part hereof, show by way of illustration, and not of limitation, specific embodiments in which the subject matter may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

Such embodiments of the inventive subject matter may be referred to herein, individually and/or collectively, by the term "embodiment" merely for convenience and without intending to voluntarily limit the scope of this application to any single embodiment or inventive concept if more than one is in fact disclosed. Thus, although specific embodiments have been illustrated and described herein, it should be appreciated that any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

In the foregoing description of the embodiments, various features are grouped together in a single embodiment for the purpose of streamlining the disclosure. This method of disclosure is not to be interpreted as reflecting that the claimed embodiments have more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate example embodiment.

Although preferred embodiments have been described herein with reference to the accompanying drawings, it is to be understood that the disclosure is not limited to those precise embodiments and that various other changes and modifications may be affected herein by one skilled in the art without departing from the scope or spirit of the embodiments, and that it is intended to claim all such changes and modifications that fall within the scope of this disclosure.

What is claimed is:

1. A method for removing moisture from a fibrous or porous material, the method comprising:

irradiating a portion of the fibrous or porous material with microwave to heat and vaporize moisture within the fibrous material during a heating cycle;

combining or alternating the microwave with RF heating for a first time interval of the heating cycle to equalize and draw the moisture within the fibrous material to at least one outer surface of the material; and alternating the heating cycle with a cooling cycle to remove moisture drawn to the at least one outer surface of the material until the at least one outer surface reaches a predetermined moisture content level.

2. The method of claim 1, further comprising alternating the heating cycle with the cooling cycle to remove the moisture evacuated therefrom until the material reaches a uniform moisture level.

3. A system for removing moisture from a fibrous or porous material, the system comprising:

an enclosure for heating and drying a fibrous or porous material enclosed therein;

a microwave delivery device positioned interior to the enclosure and directed toward the fibrous or porous material, the unit delivering microwave radiation to heat and vaporize moisture within the fibrous or porous material over a pre-determined period of time of a heating cycle, the microwave delivery device comprising two chambers;

a radio-frequency emitter positioned adjacent the device, the emitter configured to volumetrically heat at least a portion of the fibrous or porous material, wherein emitted radio-frequency energy is combinable with the microwave radiation in at least one of the two chambers to equalize a moisture content profile of the material; and a power supply operatively connected to the radio-frequency emitter and configured to energize the radio-frequency emitter for a first period of time within the heating cycle, the delivery of microwave radiation being interrupted or combined with radio-frequency heating during the first period of time, the radio-frequency emitter equalizing and drawing the moisture to at least an outer surface of the fibrous or porous material.

4. The system of claim 3, further comprising a circulating air device, the circulating air device circulating unsaturated air around the fibrous material and out of the enclosure to remove the moisture evacuated from the fibrous material during the heating cycle.

5. The system of claim 3, wherein the fibrous material is sawn lumber.

6. The system of claim 3, wherein the porous material is ceramic.

7. A method for removing moisture from a fibrous or porous material comprising:

delivering microwave energy emitted from a waveguide into a first chamber comprising a dielectric on the inner walls, the microwave energy being dispersed into the first chamber;

delivering microwave energy optionally combinable with RF energy from the first chamber to a second chamber, the second chamber being situated proximate to a zone of energy delivery, the RF energy equalizing a moisture content level of the material;

delivering the microwave energy from the second chamber to the zone of energy delivery, the fibrous or porous material being located within or proximate to the zone of energy delivery; and irradiating a portion of the fibrous or porous material within or proximate to the zone of energy delivery with microwave energy, the microwave energy removing moisture within the fibrous or porous material until the moisture content level of at least an outer surface of the material reaches a predetermined moisture content level.

8. The method of claim 7, further comprising:

delivering RF energy emitted from a pair of RF plates to the fibrous or porous material located within or near the zone of energy delivery.

9. The method of claim 7, further comprising:

the RF energy removing moisture from the fibrous or porous material located within or near the zone of energy delivery.

10. The method of claim 7, further comprising:

detecting the moisture level of the fibrous or porous material located within or near the zone of energy delivery.

11. The method of claim 7, further comprising:

transmitting a signal to a microwave generator or RF generator, the signal associated with adjusting the power level of microwave or RF.

12. The method of claim 7, further comprising:

transmitting a signal to a tuning fork, the signal adjusting an impedance level of the microwave.

13. The method of claim 7, further comprising:

transmitting a signal to at least one louver, the signal adjusting a degree of rotation of the louver in order to increase or decrease a level of microwave to the material located within or near the zone of energy delivery.

14. A system for removing moisture from a fibrous or porous material comprising:

a first microwave delivery device for delivering microwave energy emitted from a waveguide into a first chamber, the microwave energy being dispersed into the first chamber;

a second microwave delivery device for delivering microwave energy from the first chamber to a second chamber, the second chamber being situated proximate to a zone of energy delivery; and louvers having variable openings permitting the transmittal of the microwave energy from the second chamber to the zone of energy delivery, the fibrous or porous material being located within or proximate to the zone of energy delivery, a portion of the fibrous or porous material being irradiated with the microwave energy within or proximate to the zone of energy delivery, the microwave energy removing moisture within the fibrous or porous material until a moisture level of at least an outer surface of the material reaches a predetermined moisture level.

15. The system of claim 14, further comprising:

RF plates or emitters configured to deliver RF energy to the fibrous or porous material located within or near the zone of energy delivery.

16. The system of claim 14, further comprising:

the RF energy removing moisture from the fibrous or porous material located within or near the zone of energy delivery.

17. The system of claim 14, further comprising:

a moisture control device to detect the moisture level of the fibrous or porous material located within or proximate to the zone of energy delivery.

18. The system of claim 14, further comprising:

a transmitter to transmit a signal to a microwave generator or RF generator, the signal associated with adjusting a power level of microwave or RF.

19. The system of claim 14, further comprising:

a second transmitter to transmit a signal to a tuning fork, the signal adjusting an impedance level of the microwave.

20. The system of claim 14, further comprising:

a third transmitter to transmit a signal to at least one louver, the signal adjusting a degree of rotation of the louver in order to increase or decrease a level of microwave to the material located within or proximate to the zone of energy delivery.

* * * * *